US005473321A

United States Patent [19]

Goodman et al.

[11] Patent Number: 5,473,321

[45] Date of Patent: Dec. 5, 1995

[54] METHOD AND APPARATUS TO TRAIN TELEMETRY SYSTEM FOR OPTIMAL COMMUNICATIONS WITH DOWNHOLE EQUIPMENT

[75] Inventors: Kenneth R. Goodman; Robert D. Puckett, both of LaPorte, Tex.

[73] Assignee: Halliburton Company, Houston, Tex.

[21] Appl. No.: 213,166

[22] Filed: Mar. 15, 1994

[51] Int. Cl.[6] ..... G01V 1/00

[52] U.S. Cl. ..... 340/854.9; 340/853.2; 340/855.4; 367/76; 367/83; 175/40

[58] Field of Search ..... 340/853.2, 854.9, 340/855.3, 855.4; 367/81, 83, 76; 175/40; 166/250

[56] References Cited

U.S. PATENT DOCUMENTS

| | | | |
|---|---|---|---|
| 5,010,333 | 4/1991 | Gardner et al. | 340/856 |
| 5,113,379 | 5/1992 | Scherbatskoy | 367/83 |
| 5,229,765 | 7/1993 | Gardner | 340/853.2 |
| 5,253,271 | 10/1993 | Montgomery | 375/59 |
| 5,365,229 | 11/1994 | Gardner et al. | 340/855.4 |

OTHER PUBLICATIONS

Qureshi, Shahid, *Fast Start–Up Equalization with Periodic Training Sequences,* Transactions on Information Theory, vol. IT 23, No. 5, pp. 553–563 (Sep., 1977), place of publication unknown.

Milewski, A., *Periodic Sequences with Optimal Properties for Channel Estimation and Fast Start–Up Equalization,* IBM J. Res. Develop., vol. 27, No. 5, pp. 426–431 (Sep., 1983), place of pub. unknown.

Chang, R. W. and Ho, E. Y., *On Fast Start–Up Data Communication Systems Using Pseudo–Random Training Sequences,* The Bell System Technical Journal, vol. 51, No. 9, pp. 2013–2027 (Nov. 1972), place of pub unknown.

Mueller, K. H. and Spaulding, D. A., *Cyclic Equalization—A New Rapidly Converging Equalization Technique for Synchronous Data Communication,* The Bell System Technical Journal, vol. 54, No. 2, pp. 369–406, (Feb. 1975), place of publication unknown.

Bingham, *The Theory and Practice of Modem Design,* published 1988, pp. 270–277, place of publication unknown.

*Primary Examiner*—J. Woodrow Eldred

*Attorney, Agent, or Firm*—Arnold White & Durkee

[57] ABSTRACT

A telemetry system employs a periodic pseudorandom training sequence to effectively initialize an adaptive digital FIR filter-equalizer for optimal communications between a surface modem and downhole measuring equipment, without requiring any changes to the normal logging configuration or any special operator intervention. In a "training mode", an electronic source in a downhole sonde transmits a predetermined training sequence to a surface modem via a cable. The source preferably transmits the training sequence continuously until the surface modem has acclimated itself to the characteristics of the multiconductor cable by adaptively configuring the filter-equalizer, thereby enabling the surface modem to accurately interpret data received from the sonde despite attenuation, noise, or other distortion on the cable. The filter-equalizer adjusts itself in response to an error signal generated by comparing the filter-equalizer's output with a similar training sequence provided by a training generator. After the surface modem is trained, the system operates in an "operational mode," in which the sonde transmits data corresponding to downhole measurements, and the filter-equalizer's error signal is generated by comparing the filter-equalizer's output to a sliced version of the filter-equalizer's output. In this mode, the filter-equalizer continually adjusts itself to most accurately receive and interpret the data.

49 Claims, 6 Drawing Sheets

METHOD AND APPARATUS TO TRAIN TELEMETRY SYSTEM FOR OPTIMAL COMMUNICATIONS WITH DOWNHOLE EQUIPMENT

BACKGROUND OF INVENTION

1. Field of Invention

The present invention relates to well logging techniques. More particularly, the invention concerns an improved telemetry system that uses a periodic pseudorandom training sequence to initialize an adaptive finite impulse response ("FIR") filter-equalizer for optimal communication with downhole measuring equipment, without requiring any changes to the normal logging configuration or any special operator intervention.

2. Description of Related Art

Due to the increasing costs associated with drilling oil wells, well logging has become an important technique to optimize the productivity of oil wells. Generally, in well logging a sensitive measuring instrument is lowered down a borehole, and measurements are made at different depths of the well. In "open hole" well logging, for example, a sonde is lowered down an uncased borehole. The sonde is supported by a cable, which may comprise a monocable or a multiconductor cable wrapped in a steel armor. Multiconductor cables include several individual conductors, which may relay data or electrical power between the surface and the sonde. A typical individual conductor in well logging applications will have a size of about 20 gauge, and may include multiple strands of filaments made from a metallic substance such as copper. One or more conductors usually carry electrical power from the surface to the sonde. In some cases, these conductors carry direct current, and in other cases they carry 60 Hz alternating current. Other conductors of the multiconductor cable carry data from the surface to the sonde, or from the sonde up to the surface. Whether a logging system uses a monocable or a multiconductor cable, a downhole modulator-demodulator ("modem") is used to relay telemetry signals between the sonde and the cable. Likewise, a surface modem is typically used as a telemetry interface between the cable and electrical equipment at the surface.

With open hole logging, a vibrational, electrical, or nuclear source generates disturbances in strata surrounding the borehole, and these disturbances are measured by the sonde. In "production" well logging, an instrument such as a gradiomanometer, densitometer, or capacitance probe is lowered down a cased oil well to measure characteristics of the fluids in the well to determine which depths of the well are producing oil and which are not.

In both open hole and production well logging, the sonde collects information concerning its measurements, and transmits this information to electronic recording and analysis equipment at the surface. The transmission of signals from the sonde to the surface concerns the field of "telemetry." In many cases, proper operation of the telemetry system is one of the most important aspects of a logging system. As a result, geophysicists are constantly striving to improve their telemetry systems. In particular, geophysicists want to receive data from their downhole sondes in a fast and accurate manner. Therefore, it is especially desirable to achieve telemetry systems with fast data transmission rates, as well as high levels of data recognition.

However, improving the data transmission rate in open hole logging systems is limited by the bandwidth of the cable. For example, data on the cable may be attenuated due to the length of the cable. Due to the electrical characteristics of the cable, the signal is distorted by "inter-symbol interference", which refers to a residual signal that appears on a conductor after a data pulse (called a "symbol") has been received (FIG. 1). This type of interference is called "inter-symbol" interference because the residual effect of one symbol often distorts the next, adjacent symbol. In the example of FIG. 1, a signal 100 is transmitted onto a cable (not shown), and a distorted signal 102 is received at the opposite end of the cable. If inter-symbol interference results in a residual signal equal to 65% of the previous symbol, and a 15% residual signal two periods later, the distorted signal 102 will have residual amplitude of 0.65 in an interval 106. In an interval 108, the distorted signal 102 will have an amplitude of 1.15 (i.e., 1.0 due to the symbol received in the interval 108, and 0.15 due to the residual signal from the data pulse received in the interval 104). Moreover, the distorted signal will have an amplitude of 0.65 in an interval 110 (i.e., 0.65 due to the residual effect of the symbol received in the interval 108, with no remaining effect from the symbol received in the interval 104). In an interval 112, the distorted signal will have an amplitude of 0.15, due solely to the residual effect of the symbol received in the interval 108.

In addition to inter-symbol interference, data signals on an individual conductor may be further distorted by noise from data or electrical power carried on other conductors. Moreover, signal distortion may be even more insidious when small diameter conductors are used, or when high temperatures are encountered. Furthermore, the attenuation of data worsens with smaller conductor sizes and increased data transmission rates (FIG. 2).

One technique to overcome inter-symbol interference involves slowing the data transmission rate. This effectively spreads the symbols apart to reduce the "washover" from inter-symbol interference. However, this approach might not be desirable if a fast data transmission rate is needed. Other systems have been developed to help mitigate these problems, as well. One technique, generally called "equalization", utilizes an analog "equalizer" to reverse the effects of frequency-dependent attenuation in telemetry systems. An "equalizer" generally refers to a filter or amplifier that provides selected levels of gain for signals of different frequencies. Many analog equalizers are adjustable (FIG. 3A) to provide various equalization settings for cables of certain expected configurations, e.g. length, diameter, conductivity, etc. By using analog equalizers, the overall amplitude gain of a telemetry system can be made fairly constant over a desired band of frequencies (FIG. 3B).

Although known analog equalizers are beneficial in a number of ways, they are limited in certain other aspects. For example, known analog equalizers are not as adaptable as some people might like, since each setting of an analog equalizer is only designed to operate in one particular logging configuration, i.e., with cable of a specified length conductivity, noise, and other electrical characteristics.

In contrast to analog equalizers, a digital adaptive finite impulse response ("FIR") filter can readily adapt to a wide range of cable types and lengths. However, such filters are not effective until they are properly configured by initializing them, prior to operation, to a reasonably close approximation of their operating configurations. This pre-operation initialization is called "training." In one known training technique (FIG. 4), a logging cable 400 is removed from the borehole, and a surface modem 402 is coupled to the cable 400. A transmitting port 404 of the surface modem 402 is coupled to one end of the cable 400, and a receiving port 406 is coupled to the other end of the cable 400. Then, the transmitting port 404 sends a specified signal to the receiving port 406 via the cable 400. Since the contents of the specified signal and the precise time of sending the signal are known, the relationship between the signals sent and the signals actually received can be analyzed to configure the adaptive FIR filter to accurately interpret the received signals. This technique is addressed in U.S. Pat. No. 5,010,333 ('333), issued on Apr. 23, 1991, to Gardner et al. The '333 patent is hereby incorporated herein by reference in its entirety.

More specifically, with the technique of the '333 patent, the surface modem 402 transmits a long period, pseudorandom signal over the cable 400. This signal is received by the surface modem 402 and compared to the transmitted signal to characterize the effect of the cable 400, and configure the filter appropriately. In particular, the comparison of transmitted and received signals yields error signals, which are processed to determine coefficient signals of the filter. The filter processes received signals and adjusts its coefficient signals until the error signals are minimized. After the error signals are minimized, a delay of about 25 seconds is performed to ensure that the coefficient signals have stabilized. Then the coefficient signals are stored in memory, the cable 400 is disconnected from the receiving port 406, and the cable 400 is connected to a sonde and lowered downhole. Then, the stored coefficient signals are used to initialize the modem 402 in anticipation of receiving data from the sonde.

In some cases, such as the system of the '333 patent, it may be necessary to re-train a filter after the logging cable is placed downhole. This may occur, for example, due to equipment malfunction or replacement. In these cases, the logging cable must be removed from the borehole, which is usually a laborious, expensive process. After the modem is re-trained, the coefficient signals are recorded in memory and the logging cable and sonde are lowered downhole. Then, the stored coefficient signals are used to initialize the surface modem prior to receiving actual data signals from downhole. The set of trained coefficient signals is unique for each different logging cable.

Although many people have found this approach to be sufficient for their purposes, it may be somewhat limited when considered for other applications. For instance, the filter must be re-trained under various circumstances, such as when (1) the logging cable is replaced, (2) the surface modem is replaced, or (3) the original coefficient signals are corrupted, for example, by operator error. Moreover, training performed at the surface may not be as accurate as desired, since the electrical characteristics of the logging cable typically change when the cable is extended downhole, due to high downhole temperatures that are often unpredictable in magnitude and may even vary with depth. In some situations, then, it would be desirable to train the surface modem while the cable is extended downhole, i.e. while the cable is in situ.

SUMMARY OF INVENTION

The present invention concerns an improved telemetry system that employs a periodic pseudorandom training sequence to automatically "train" an adaptive FIR filter-equalizer to an individual logging cable, while the cable is in situ. In accordance with the invention, the parameters of the filter-equalizer may be trained without disturbing the normal logging configuration, and without requiring any special operator intervention. In an exemplary embodiment, the invention employs a telemetry system including a sonde equipped with an electronic training sequence transmitter. The training sequence transmitter includes circuitry programmed to transmit a predetermined analog signal called a "training sequence" uphole on one or more conductors of a downhole logging cable. A surface modem receives the training sequence at the surface, subject to any attenuation, noise, and other distortion on the logging cable.

The training sequence transmitter preferably transmits the training sequence continuously until the surface modem has acclimated itself to the characteristics of the logging cable. The surface modem acclimates itself to the cable by configuring an adaptive FIR filter-equalizer, thereby enabling the surface modem to accurately interpret signals received from the sonde, despite any attenuation, noise, or other distortion present on the logging cable. When moved from borehole to borehole for different jobs, the surface modem may be "trained" at each site to most effectively operate under the conditions encountered at that site.

The surface modem includes transmitter, and receiver modules for transmitting and receiving signals to/from the logging cable. The receiver module generally operates in two modes: (1) in a training mode, where the modem initializes the FIR filter-equalizer itself to be compatible with the logging cable, by using the received training sequence; (2) in an operational mode, where the modem receives downhole logging data from the sonde and continuously "fine-tunes" itself to the characteristics of the logging cable.

The receiver module of the surface modem uses an analog-to-digital converter ("ADC") to convert analog signals received from the sonde via the logging cable into digital signals. The receiver module also includes a FIR filter-equalizer, which includes a multi-stage buffer, a number of multipliers, storage for a number of coefficient signals, and an accumulator. A slicer is provided to associate each digital signal output by the filter-equalizer with a discrete signal level. Additionally, a training sequence generator is used to provide a continuously repeating training sequence, which is identical in content to the training sequence provided by the training sequence transmitter. In the training mode, the filter-equalizer uses the output from the training sequence generator to assist in establishing its coefficient signals. In the operational mode, the filter-equalizer uses the slicer output, instead of the training sequence generator output, to adjust the coefficient signals.

The training mode may be initiated, for example, when the system is powered-up, or in response to a downlink command sent from the surface modem to the sonde. The training sequence transmitter continuously transmits the training sequence to the surface modem, and the surface modem repeatedly digitizes received data signals and collects the data in its buffer until the output from the slicer matches, or nearly matches, the known training sequence. When this occurs, the coefficients of the filter-equalizer are suitably initialized.

More specifically, an error signal, based upon signals produced by the training sequence generators and the accumulator, is used to influence adjustment of the filter-equalizer's coefficient signals. When the error signal is minimized, and the coefficient signals are stabilized, the surface modem sends a specified command to the sonde, instructing the source to stop sending the training sequence and to begin sending actual data signals corresponding to downhole measurements. A multiplexer then provides the filter-equalizer with signals from the slicer, rather than signals from the training sequence generator. Thereafter, the coefficient signals are adjusted as needed, depending upon the difference between the slicer's output signal and the data signals received from the sonde. These adjustments are continued as long as data signals are transmitted from the sonde to the surface modem. In this way, the coefficient signals are continuously "fine-tuned," thereby assuring accurate reception of data signals from the sonde.

BRIEF DESCRIPTION OF DRAWINGS

The nature, objects, and advantages of the invention will become more apparent to those skilled in the art after considering the following detailed description in connection with the accompanying drawings, in which like reference numerals designate like parts throughout, wherein.

DESCRIPTION OF A PREFERRED EMBODIMENT

Structure

Figure 1:
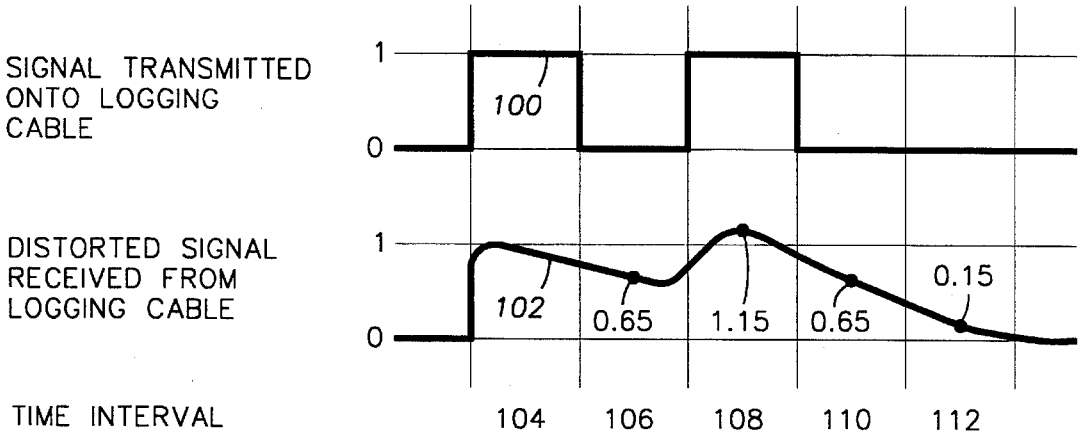
FIG. 1 contains two graphs illustrating a signal 100 transmitted over a downhole logging cable and a corresponding signal 102 received over the logging cable, wherein the received signal 102 is afflicted with attenuation and distortion.
Figure 2:
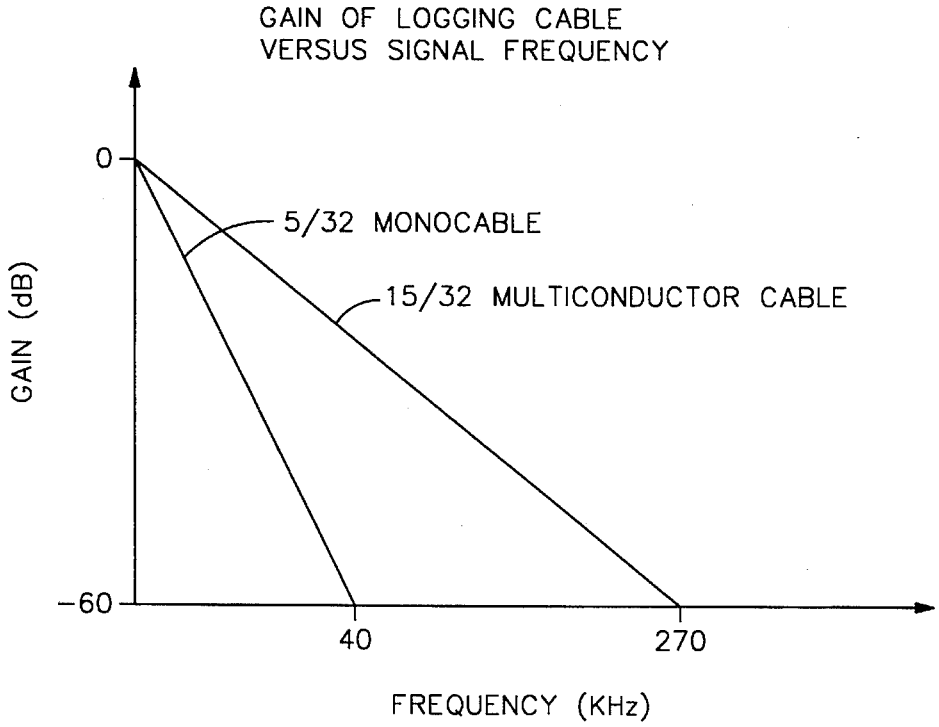
FIG. 2 is a graph illustrating the attenuation of data conveyed by a telemetry system as a function of frequency for two typical wireline cables.
Figure 3A:
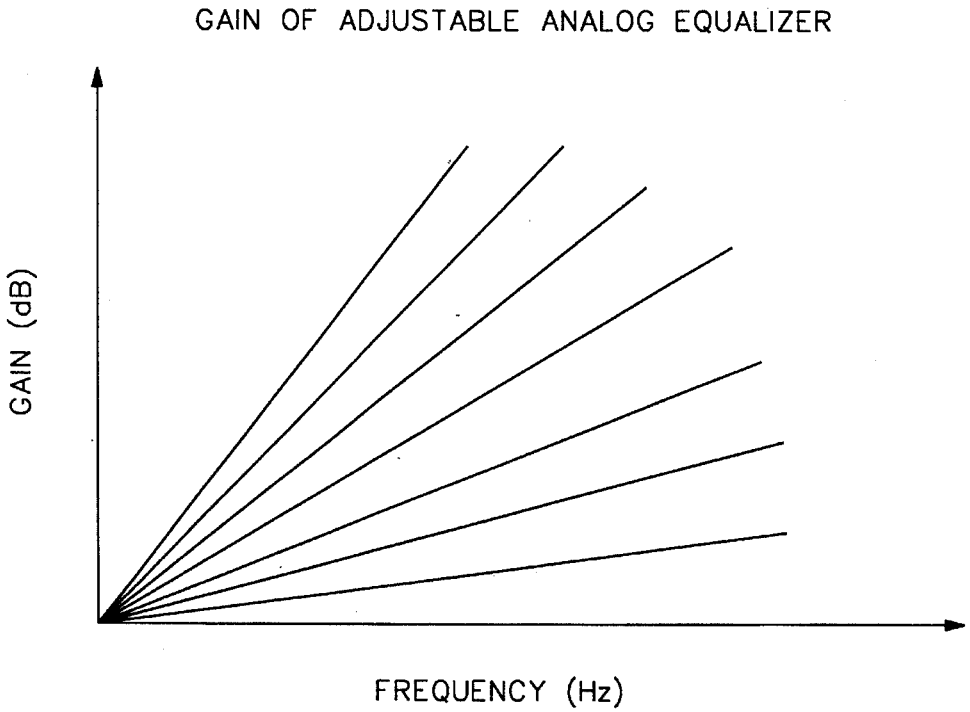
FIG. 3A is a graph illustrating various frequency responses provided by a multi-stage analog equalizer.
Figure 3B:
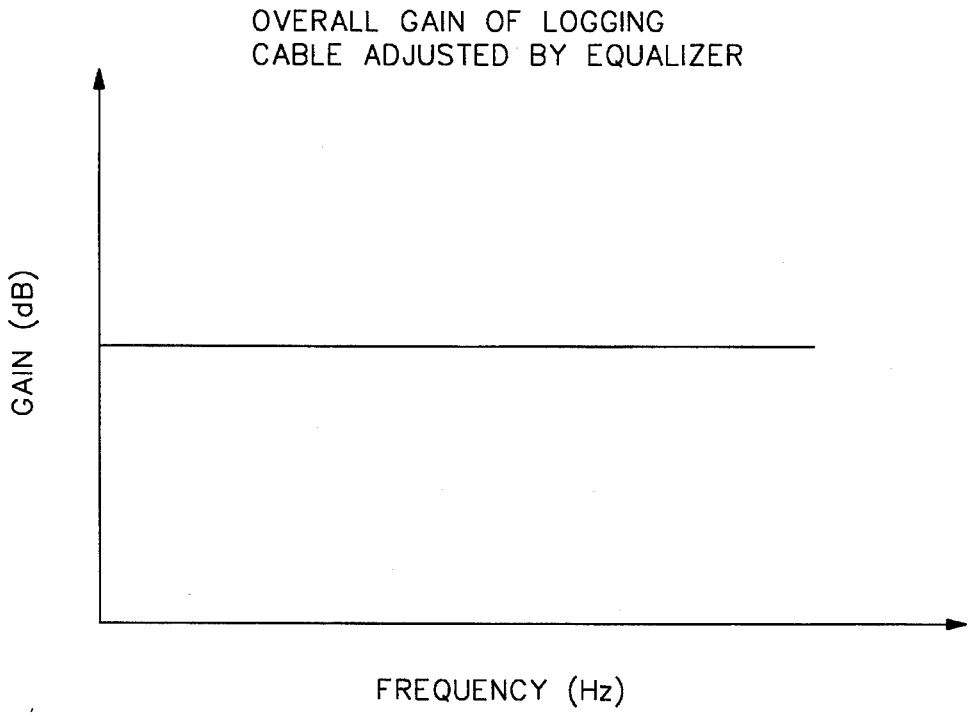
FIG. 3B is a graph illustrating the constant gain of a multiconductor cable whose frequency response has been modified by an analog equalizer.
Figure 4:
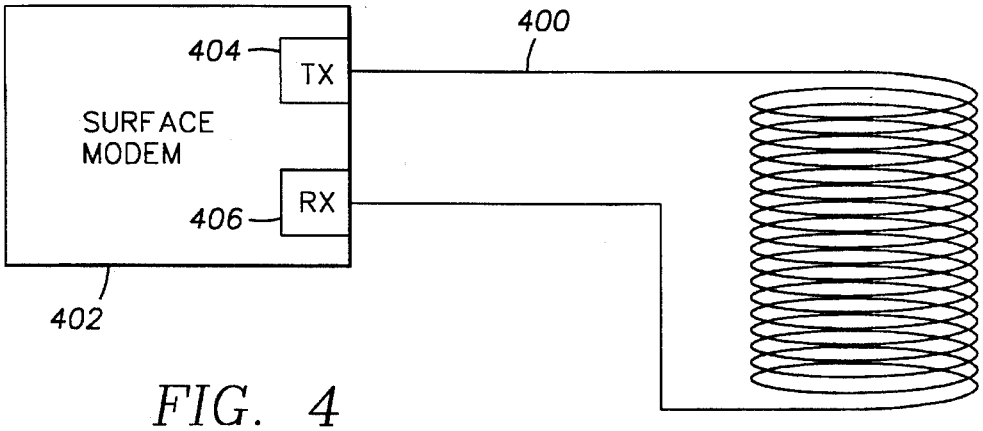
FIG. 4 is an illustration depicting a known arrangement for training a surface modem.

An exemplary embodiment of the invention may be implemented using a telemetry system 500 that includes a surface modem 505 (FIG. 5) electrically connected to a sonde 502 via a logging cable 504. The surface modem 505 includes a receiver module 505*a* and a transmitter module 505*b*. The sonde 502 is equipped with a communications module (not shown) for exchanging signals with the surface modem 505. The communications module includes a downhole modem (not shown) and a downhole training sequence transmitter 506. The training sequence transmitter 506 comprises electronic circuitry programmed to transmit a modulated analog pseudorandom "training sequence" to the surface modem on the logging cable 504. At the surface, the receiver module 505*a* receives the training sequence, subject to any attenuation, noise, or other distortion on the logging cable 504.

In a 3-level communications system, the training sequence may comprise a signal 600 (FIG. 6) having a designated number of elements, called "symbols." The signal 600, for example, is classified as a "3-level" signal since the symbols may comprise one of three different voltage levels: +15 V, 0 V, or −15 V. The signal 600 may also be represented digitally, as shown by elements in the digital sequence 602: −1, −1, 0, 0, 0, +1. The training sequence transmitter 506 preferably sends the training sequence continuously until the surface modem 505 adjusts itself to the characteristics of the logging cable 504. The surface modem 505 performs this adjustment by configuring a filter-equalizer 510. Ultimately, the filter-equalizer 510 is configured to accurately interpret signals received from the sonde 502 despite any attenuation, noise, or other distortion on the conductor 504. In an illustrative embodiment, each time the surface modem 500 is powered-up, the filters-equalizer 510 "trains" itself in accordance with the particular conditions encountered at that time and place.

The surface modem 505 generally operates in two modes: (1) In a "training" mode, the surface modem 505 uses the training sequence to train itself to be compatible with the logging cable 504; (2) In an "operational mode," the surface modem 505 receives data signals corresponding to downhole logging measurements made by the sonde 502. In the operational mode, the modem 505 continuously "fine-tunes" itself as more data is received. Operation of the surface modem 505 is discussed in greater detail below.

The surface modem 505 includes an automatic gain control circuit ("AGC") 507, which is electrically connected to the logging cable 504. The AGC 507 amplifies analog data signals transmitted by the sonde 502 over the logging cable 504. Connected to the AGC 507 is an analog-to-digital converter ("ADC") 508, which converts analog data signals provided by the AGC 507 into digital signals. The ADC 508 is electrically connected to a clock recovery unit 509, which is also connected to the AGC 507. The clock recovery unit 509 provides timing signals to the ADC 508 to determine when the ADC 508 samples the analog signals received from the AGC 507.

Figure 6:
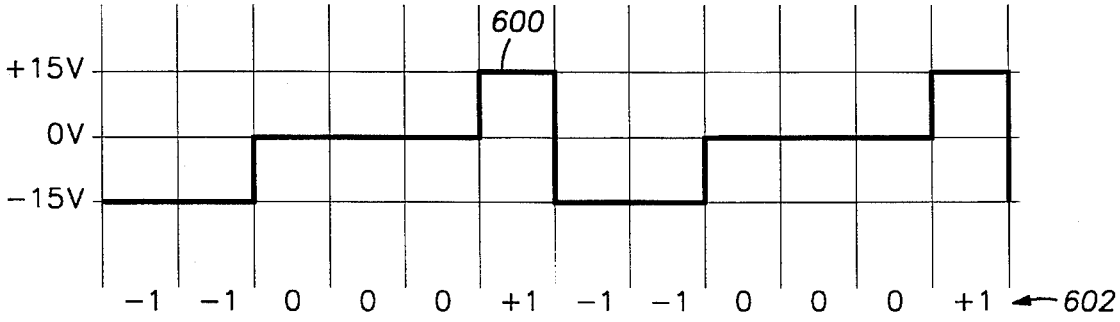
FIG. 6 is a diagram of an exemplary training sequence for a 3-level communications system in accordance with the invention.
Figure 5:
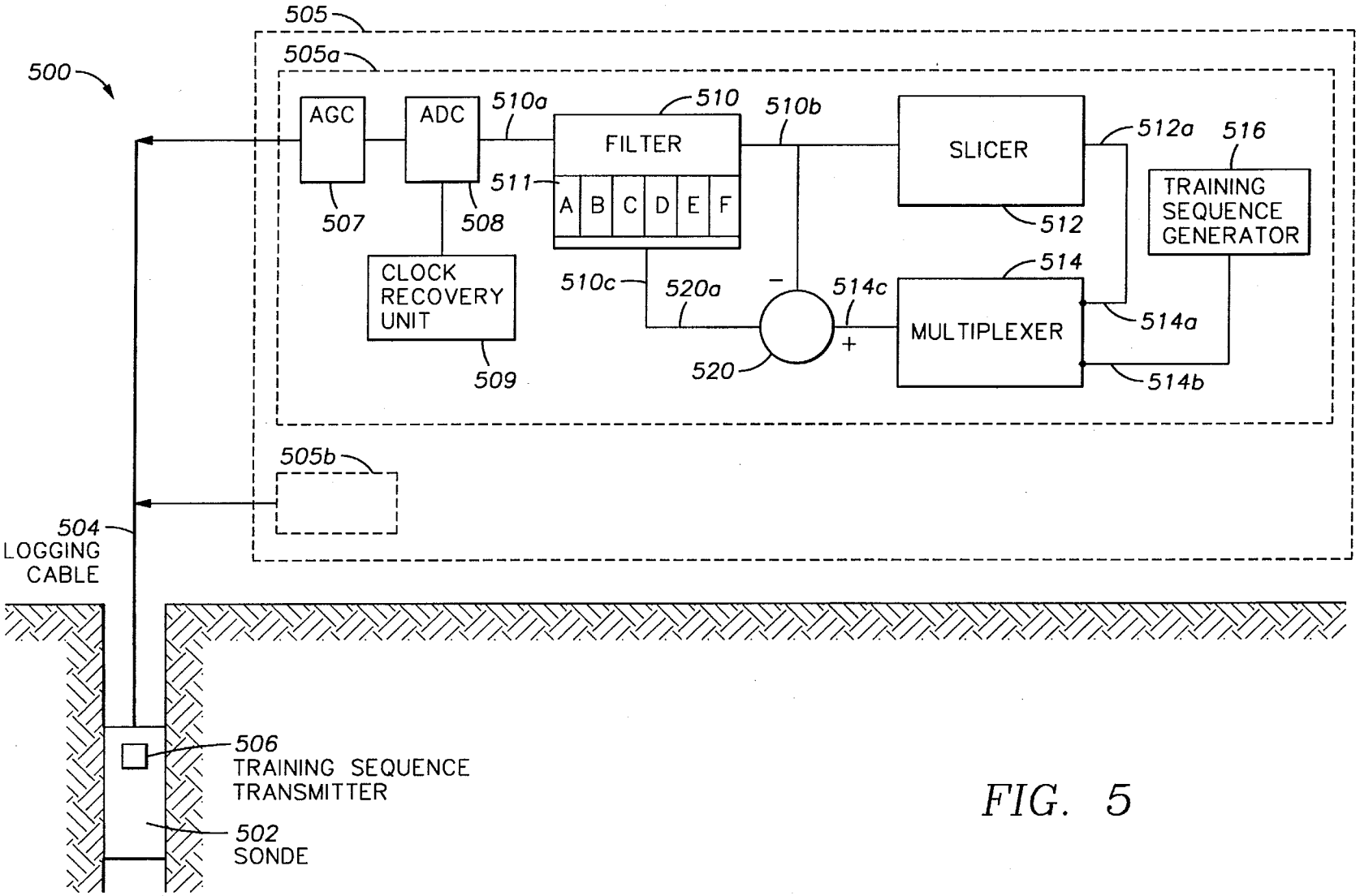
FIG. 5 is a block diagram illustrating the hardware components and interconnections of an illustrative telemetry system 500 in accordance with the invention.

The ADC 508 is electrically attached to an input 510*a* of the filter-equalizer 510. The filter-equalizer 510 comprises a finite impulse response ("FIR") filter-equalizer, the operation of which is discussed in greater detail below. The filter-equalizer 510 includes a number of taps 511*a*–511*f*, equal in number to the number of symbols in a single period of the training sequence. In FIG. 5, six taps 511*a*–511*f* are provided as an example, for ease of explanation. Accordingly, the pseudorandom training sequence has a fundamental period that includes six symbols, as shown in FIG. 6. However, the filter-equalizer 510 preferably includes at least 30 taps when implemented in wireline logging applications.

The filter-equalizer 510 also includes an filter-equalizer output 510*b* and a feedback input 510*c*. The filter-equalizer output 510*b* is electrically connected to a slicer 512. In an illustrative embodiment, where the filter-equalizer 510 is implemented using digital signal processing circuitry, the filter-equalizer 510 may provide a digital signal between +1700 and −1700 on the output 510*b*. As discussed in greater detail below, the slicer 512 receives the digital signals provided by the filter-equalizer 510, and associates each of these signals with a discrete signal level. In a 3-level system with digital filter output signals between +1700 and −1700, for example, when the slicer 512 receives a digital signal having a value of greater than +567, the slicer may be programmed to interpret such signals as level +1. Similarly, the slicer 512 may interpret digital signals with a value between +567 and −567 as a level 0. Likewise, the slicer 512 may be programmed to interpret signals less than −567 as a level −1.

The slicer 512 provides an output signal at a slicer output 512*a*, which is electrically coupled to a first input 514*a* of a multiplexer 514. The multiplexer 514 additionally includes a second input 514*b*, which is connected to a training sequence generator 516. The generator 516 provides the multiplexer 514 with a continuously repeating, pseudorandom training sequence, containing the same symbols as the training sequence provided by the downhole training sequence transmitter 506. In accordance with the invention, and as discussed in greater detail below, training sequences from the generator 516 and the transmitter 502 are not necessarily synchronized.

The multiplexer 514 includes an output 514*c*, which is electrically connected to an error unit 520. The error unit 520 generates an error signal at an error output 520*a* by subtracting the signal from the multiplexer output 514*c* from the filter-equalizer output signal (510*b*). The error unit 520 directs the error signal to a feedback input 510*c* of the filter-equalizer 510. In a preferred embodiment, the filter 510, slicer 512, multiplexer 514, training sequence generator 516, and error unit 520 may be implemented by using a digital signal processor such as an Analog Devices model ADSP2101 integrated circuit.

Figure 7:
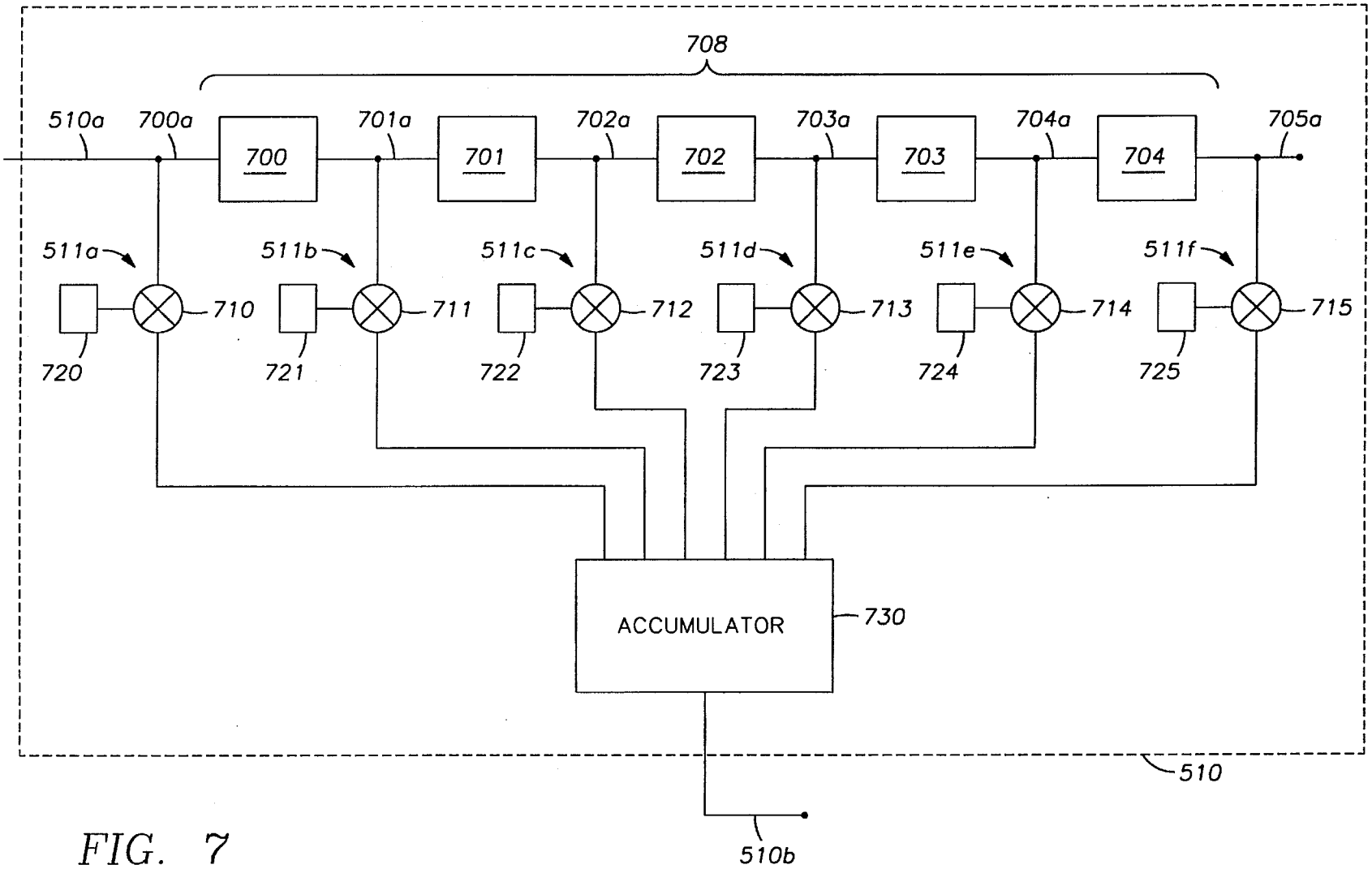
FIG. 7 is a block diagram illustrating the filter-equalizer 510 of the invention in greater detail.

The construction of the filter-equalizer 510 is shown in greater detail in FIG. 7. In an exemplary embodiment, using a six-symbol training sequence, the filter-equalizer 510 includes a buffer 708 that includes five delay stages 700–704, corresponding to six tap lines 700*a*–705*a*. The filter-equalizer 510 also includes six multipliers 710–715, each corresponding to a different tap line 700*a*–705*a*. For example, the multiplier 710 corresponds to the tap line 700*a*. Each multiplier 710–715 serves to multiply the signal present on its respective tap line 700*a*–705*a* by a coefficient signal provided by a corresponding coefficient storage unit 720–725. The coefficient signals are selected in accordance with the invention, as discussed in greater detail below. Signals from the multipliers 710–715 are collected by an accumulator 730, which provides an equalized output signal on the filter-equalizer output 510*b*.

Operation

Figure 8:
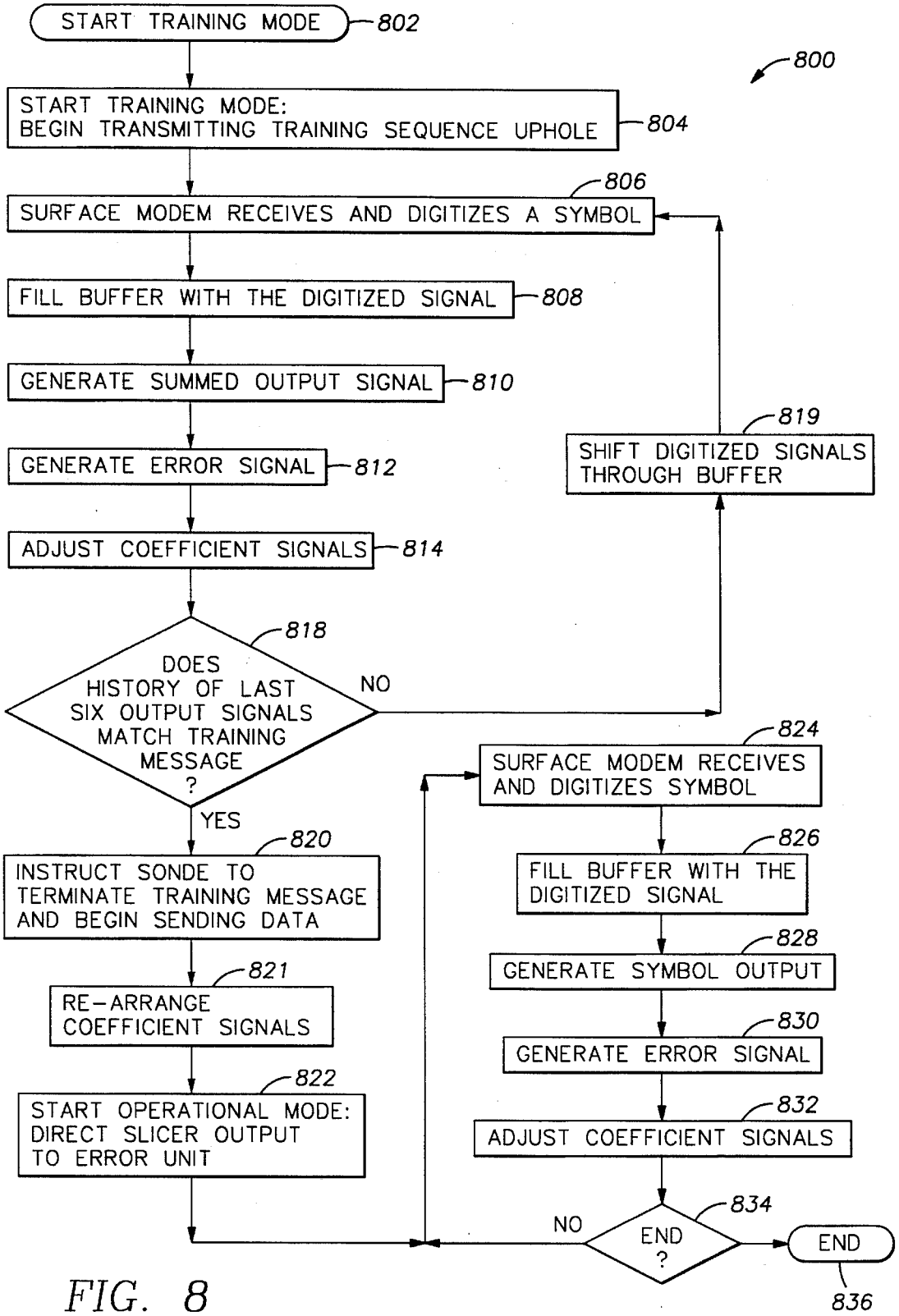
FIG. 8 is a flowchart illustrating an exemplary operating sequence of the surface modem 505, in accordance with one embodiment of the invention.

In accordance with one embodiment of the invention, the operating sequence of the surface modem 505 may be implemented in the form of a number of tasks 800 (FIG. 8). In one embodiment, the tasks 800 are initiated when power is first applied to the surface modem 505, i.e., when the surface modem 505 and the sonde 502 are "powered-up." In another embodiment, the tasks 800 are initiated when the surface modem 505 transmits a specific downlink command to the sonde 502 during an ongoing exchange of data between the surface modem 505 and the sonde 502.

Task 802 begins operating the surface modem 505 in the training mode, which functions to initialize the coefficient signals of the filter-equalizer 510 prior to receiving any data signals corresponding to downhole measurements. To begin the steps involved in the training mode, the transmitter 506 in task 804 begins sending the training sequence uphole via the logging cable 504. As mentioned above, the transmitter 506 may begin sending the training sequence when the surface modem 505 and sonde 502 are first "powered-up," or when the surface modem 505 issues a specific downlink command to the sonde 502.

The training sequence comprises a pseudorandom sequence of symbols, or in other words, a constant amplitude, zero-autocorrelation sequence known as a "CAZAC" sequence. In general, CAZAC sequences include a designated number of symbols in a series, where that series minimizes the number of repeating patterns of shorter length than the designated number. CAZAC sequences are addressed in Milewski, "Periodic Sequences with Optimal Properties for Channel Estimation and Fast Start-Up Equalization", IBM J. or Research & Development, V.27, pp. 426–431 (September 1983). The Milewski reference is hereby incorporated herein by reference in its entirety. In the present discussion, there are six symbols in the repeating pattern of the training sequence. However, in actual wireline logging applications, a training sequence of at least 30 symbols is preferred. In accordance with the present invention, the number of symbols in the training sequence matches the number of taps 511*a*–511*f* in the filter-equalizer.

In task 806, the surface modem 505 receives a symbol of the analog training sequence sent by the transmitter 506, and the AGC 507 amplifies the signal as needed, to provide a signal of a specified amplitude. Then, the ADC 508 digitizes the received symbol. The digitized symbol is directed to the filter-equalizer 510 in task 808, wherein the ADC 508 advances the digitized symbol onto the tap line 700*a*. Eventually,,after task 808, the routine 800 is repeated sufficiently to perform six times, six symbols will be sequentially advanced onto all six lines 700*a*–705*a*, filling the buffer 708 with signals.

Figure 9:
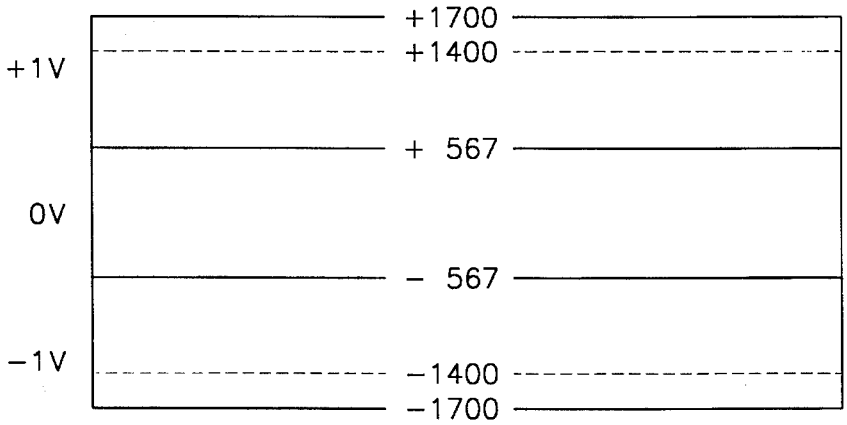
FIG. 9 is a graph illustrating the operation of the slicer 512 in accordance with the invention.

After task 808, the filter-equalizer 510 in task 810 generates a summed output signal on the output 510*b* based on the signals present on the tap lines 700*a*–705*a*. In accordance with FIG. 9, if an output signal is a digital +1400, the slicer 512 interprets it as a level +1 signal. Likewise, if the slicer 512 receives an output signal of −1400, it is resolved as being a level −1 signal. In an exemplary embodiment, each of the coefficient signals may be initially set to zero. Therefore, when task 810 is performed for the first time, the signal on the filter-equalizer output 510*b* will be zero.

Next, task 812 computes the error signal, by subtracting the filter-equalizer output 510*b* from the signal from the training sequence generator 516. Then, task 814 adjusts the coefficient signals stored in the coefficient storage units 720–725, according to Equation 1 (below).

$$C_{x\text{-}new}=C_{x\text{-}old}-(\beta*ERR*DV_x) \quad [1]$$

where:

$C_{x\text{-}new}$=the new coefficient for the xth tap;

$C_{x\text{-}old}$=the old coefficient for the xth tap;

β=a sensitivity constant, explained below;

ERR=the error signal present at the error output 520*a*; and $DV_x$=the digitized signal that is present at the xth tap.

The sensitivity constant "β" adjusts the rate at which the coefficient signals are changed. In particular, a larger value of β will cause the coefficient signals to adapt more quickly. However, when β is too large, the coefficient signals may change too quickly, resulting in instability. With smaller values of β, the coefficient signals will adapt more slowly. However, when β is too small, the coefficient signals may change too slowly, or not at all.

Generally, β depends upon the amount of expected noise, and may be selected in practice using trial and error. In downhole well logging applications, it has been observed that a useful range for β is between 0.005 and 0.01. Therefore, an illustrative value of β would be 0.008.

After adjusting the coefficient signals in task 814, query 818 asks whether the last six sliced output signals (512*a*) match the last six symbols of the training sequence generator 516. If not, task 819 shifts the digitized symbols through the buffer, such that each digitized symbol is shifted to the next adjacent line 700*a*–705*a*. The digitized symbol present at the line 705*a* is shifted to the line 700*a*. Then, control is returned to task 806, where a new symbol is digitized. Tasks 806–818 are repeated, then, for each new symbol received from the training sequence generator 506.

When the answer to query 818 is yes, task 820 sends a command to the sonde 502 instructing the transmitter 506 to stop sending the training sequence, and for the sonde 502 to begin sending data signals corresponding to actual downhole measurements. Then, task 821 re-arranges the coefficient signals by shifting them among the taps 511*a*–511*f*, such that the largest coefficient is positioned near the middle of the buffer 708. For example, the largest coefficient signal may be located at the tap 511*d*. This rearrangement is helpful to configure the filter-equalizer 510 to optimally match the impulse response of the cable 504.

After task 821, task 822 places the surface modem 505 in the operational mode. Specifically, the multiplexer 814 in task 822 directs signals from the slicer 512, instead of signals from the training sequence generator 516, to the output 514*c*. Thereafter, the filter-equalizer 510 will continue to re-adjust its coefficient signals in accordance with the error between the filter-equalizer's output signal (510*b*) and the slicer output signal (512*a*).

In particular, the surface modem 505 receives and digitizes a new symbol in task 824, then shifts the digitized signal into the buffer 708 in task 826. Then, the filter-equalizer 510 computes an output based on the data signals present on the tap lines 700*a*–705*a*, the coefficient signals having been previously initialized during steps 806–818. Next, in task 830, the error unit 520 generates an error signal by subtracting the signal on the filter-equalizer output 510*b* from the signal on the slicer output 512*a*. Then, in task 832 the filter-equalizer 510 adjusts the coefficient signals stored in the coefficient storage units 720–726 according to Equation 1 (as explained above). Unless an end condition occurs, these steps are repeated as long as data is transmitted from the sonde 502 to the surface modem 505. In this way, the coefficient signals are continuously adjusted, thereby assuring accurate reception of data from the sonde 502. The routine 800 ends in task 836 which may occur, for example, when query 834 determines that the sonde 502 and/or the surface modem 505 have been manually powered down.

An exemplary operating sequence of the surface modem 505 will now be discussed, with reference to Table 1, which is appended hereto and incorporated by reference in its entirety. Table 1 contains a listing of numbers 1100 representative of signals present at various locations in the telemetry system 500 at various times. More specifically, Table 1 includes a number of lines 1102, where each line 1102 represents the signals present at various locations of the telemetry system 500 at a given moment. For example, a first line 1104 represents the signals present at certain locations at a first time, a second line 1106 represents the signals at a second time, a third line 1108 represents the signals at a third time, etc.

Column 1110 represents the signals that have been sent uphole by the sonde 502 during power down (all zeros), training (repeating sequence of −1, −1, 0, 0, 0, +1), and ongoing operation (a stream of −1's, 0's, and +1's). The numbers of column 1110 are provided for explanatory purposes only, since during operation of the telemetry system 500, the signals transmitted by the sonde 502 are not immediately available to the surface modem 505. The surface modem 505, in particular, only has access to the signals received on the cable 504, which are digitized by the ADC 508. These digitized Signals are represented in column 1112, which includes a randomly added or subtracted error ranging from +0.05 to −0.05, to simulate errors encountered in the field.

Column 1114 represents the summed signals present at the filter-equalizer output 510*b*, and column 1115 represents the signals provided by the training sequence generator 516. For ease of calculation and explanation, the signal supplied by the training sequence generator 516 is shown to be synchronized with the signal sent by the training sequence transmitter 506. Although the transmitter 506 and generator 516 always provide symbols of identical content and order, when implemented in the field they are not assumed or expected to produce sequences that are synchronized with each other.

Column 1116 represents the signals present at the error output 520*a*, and column 1118 represents the signals present at the slicer output 512*a*. Columns 1120 represent the signals present at the coefficient storage units 720–725. The numbers in the columns 1110, 1112, 1114, 1116 and 1120 of Table 1 have been rounded to the nearest hundredth of a unit. And, although the signals in columns 1112, 1114–16, 1118, and 1120 are represented as floating point numbers, such a representation is made chiefly for ease of understanding, since these signals, when implemented in hardware, may comprise digital integers in a range such as −1700 to +1700.

In the lines 1122, the training sequence transmitter 506 has not yet been powered-up, as is evident from the zeros in column 1100. In line 1124, the training sequence transmitter 506 has sent a "−1" signal uphole. Furthermore, by reading down column 1110, it can be seen that the training sequence transmitter 506, beginning with line 1124, is sending the following repeating pattern (i.e., training sequence): −1, −1, 0, 0, 0, 1.

In line 1124, the ADC 508 has digitized a signal having the value of −1.04, representing an error of −0.04, presumably due to noise on the cable. The filter-equalizer output 510*b*, shown in column 1114, is zero. Although the digitized value of −1.04 is present at the tap line 700*a*, the output 510*b* is zero since each coefficient is initially set to zero, as shown in the lines 1122 of the columns 1120. Accordingly, the accumulator 730 produces a summed value of zero, as shown in column 1114. Since a discrepancy exists between the transmitted symbol from downhole (column 1110) and the sliced signal provided by the surface modem 505 (column 1118), the error is noted by an asterisk 1126.

The modification of the coefficients then occurs as follows, where for the present discussion, the sensitivity constant β has been set at 0.08. The new coefficient for the first tap 511*a* is determined using Equation 1, reproduced below.

$$C_{1\text{-}new}=C_{1\text{-}old}-(\beta*ERR*DV_1) \quad [1]$$

More specifically, the values to be used in Equation 1 are as follows:

$C_{1\text{-}old}=0$ $\beta=0.08$ $ERR=-1$ $DV_1=-1.04$

Implementing Equation 1 with these specific values, the new coefficient at the tap 510*a* is calculated as shown in Equation 2 (below).

$$C_{1\text{-}new}=0+(0.08*-1*-1.04)=0.0832\approx0.08 \quad [2]$$

Likewise, the coefficients at the taps 510b–511f are calculated as shown in Equations 3–7, below.

$$C_{2\text{-}new}=0+(0.08*-1*0)=0 \quad [3]$$

$$C_{3\text{-}new}=0+(0.08*-1*0)=0 \quad [4]$$

$$C_{4\text{-}new}=0+(0.08*-1*0)=0 \quad [5]$$

$$C_{5\text{-}new}=0+(0.08*-1*0)=0 \quad [6]$$

$$C_{6\text{-}new}=0+(0.08*-1*0)=0 \quad [7]$$

After the line 1124, the next symbol sent by the training sequence transmitter 504 is another "–1" (see line 1128, column 1110). However, due to inter-symbol interference having an amplitude of about –0.62, the ADC 508 receives and digitizes a signal having the value of –1.62 (column 1112). In this case, the filter-equalizer output 510b (column 1114) is –0.13. This occurs since multipliers 710–715 and accumulator 730 provide the sum shown in Equation 8, below.

$$SUM=(-1.62*0.08)+(-1.04*0)+(0*0)+(0*0)+(0*0)+(0*0)=0.13 \quad [8]$$

Since the filter-equalizer output 510b (column 1114) is 0.13, the output of the slicer output 512a provides a value of 0. And, since a discrepancy exists between the transmitted symbol from downhole (column 1110) and the sliced signal provided by the surface modem 505 (column 1118), the error is noted by an asterisk 1128. The signal on the error output 520a is calculated to be –0.13, obtained by subtracting the signal at the filter-equalizer output 510b (i.e. –0.13) from the output from the training sequence generator 516 (i.e. –1), as shown in Equation 9 (below).

$$ERR=-1-(-0.13)=-0.87 \quad [9]$$

Having calculated these values, the coefficient signals are determined as shown in Equations 10–15 (below).

$$C_{1\text{-}new}=0.08+(0.08*-0.87*-1.62)=0.1959\approx 0.2 \quad [10]$$

$$C_{2\text{-}new}=0+(0.08*-0.87*-1.04)=0.0734\approx 0.07 \quad [11]$$

$$C_{3\text{-}new}=0+(0.08*-0.87*0)=0 \quad [12]$$

$$C_{4\text{-}new}=0+(0.08*-0.87*0)=0 \quad [13]$$

$$C_{5\text{-}new}=0+(0.08*-0.87*0)=0 \quad [14]$$

$$C_{6\text{-}new}=0+(0.08*-0.87*0)=0 \quad [15]$$

Using the above-described techniques, these iterations may be repeated to provide the remaining values shown in Table 1.

Although no more errors are found after the asterisk 1130, the coefficient signals (columns 1120) continue to stabilize after that point. Therefore, the present invention contemplates ending the training mode by first waiting for the training generator output 514b and the slicer output 512a match each other, and then waiting for a predetermined time to ensure that the coefficient signals have stabilized. In an illustrative embodiment, the predetermined time corresponds to about 1000 symbols, which would require about 100 ms.

Beginning with the line 1129, Table 1 illustrates signal values corresponding to the operational mode, wherein actual data signals were received from the transmitter 506 instead of the training sequence, and wherein the slicer output 512a was fed to the multiplexer 514 instead of the generator output 514b.

Testing

An exemplary system of the present invention was implemented, using a surface modem that was specifically constructed for the test. The surface modem transmitted data signals at 360 kilobytes/second, with odd parity. The transmitted data signals ranged between about +15 V and –15 V, where ideal data signals were established in seven levels: about +15, +10, +5, 0, –5, –10, and –15 V.

The filter-equalizer and processing electronics of the surface modem were implemented using an Analog Devices model ADSP2101 digital signal processing integrated circuit. A 12-bit ADC was used, running at about 360 KHz. A Cable length of 30,000 feet was chosen, to simulate the longest cables currently used. The cable included a 7/16 inch 7-conductor cable, as is typically used in wireline logging.

To measure success of the surface modem under test, a bar graph display of light emitting diodes was coupled to the signal processing chip, where each successive increment of the bar represented an incrementally greater amount of error. Specifically, the bar graph display was attached to the error output 520a, to visually display a representation of the error signal. Within several hundred milliseconds of initiating the surface modem, the bar graph display showed that the errors had been reduced to negligible amounts, indicating that the coefficients had equalized. To further test the method of the invention, the downhole modem began sending pseudorandom data periodically punctuated with a brief synchronization message comprising $AA55_{HEX}$, in even parity. In this test, the trained surface modem correctly interpreted the synchronization pattern.

Conclusion

The present invention provides its users with a number of advantages. For example, the invention provides reduced cost in contrast to prior arrangements, since the invention uses a less-complicated hardware arrangement and eliminates a number of components of specialized training hardware and associated logic in the surface modem. For instance, the following components are not necessary: uplink cable transmitters, modem switching relays, non-volatile memory and first-in-first-out ("FIFO") memories, and connectors used for logging cable loop-back. Furthermore, the invention requires less assembly and check-out time in manufacturing, with less hardware to maintain, than previous arrangements.

The invention also provides increased reliability when compared to earlier arrangements. This is a result, at least in part, of the reduction of components as described above. Moreover, the invention is easier to use in the field, since no operator intervention is required, and since the surface modem may be configured to automatically train itself upon power-up. Another advantage of the invention is that failed modems can be replaced on site without significantly interrupting logging operations. The invention additionally provides increased performance, such as its significantly shorter training time.

While there have been shown what are presently considered to be preferred embodiments of the invention, it will be apparent to those skilled in the art that various changes and modifications can be made herein without departing from the scope of the invention as defined by the appended claims.

For example, the present invention may be modified for applications where the uplink data rate is slow, such as measurement while drilling ("MWD") applications. Specifically, the filter-equalizer 510 of the invention may be operated to fill the buffer 708 only once, and rotate the signals in the buffer 708 repeatedly to initialize the coefficient signals of the filter-equalizer 510. In this embodiment, the surface modem 505 fills the buffer 708 once, then repeatedly processes the data until the buffer 708 is "stabilized," i.e. where the received pattern of symbols is seen to repeat. Then, the filter-equalizer 510 processes the "captured" signals to initialize the coefficient signals. In this way, training time is reduced, since the surface modem 505 is not delayed to wait for receipt of signals transmitted from downhole at a slow data rate during the initialization of the coefficients.

Another embodiment is also contemplated, for applications where there is a need to optimize processing speed. In this embodiment, the coefficient signals may be adjusted in groups of less than all of the coefficient signals, such as individually, or by twos. Although this embodiment provides a somewhat increased initialization time, the computational load on the surface modem is decreased.

TABLE 1

| 1110 data | 1112 a/d | 1114 sum | 1115 gen | 1116 err | 1118 out | 1120 data coefficients | | | | | | |
|---|---|---|---|---|---|---|---|---|---|---|---|---|
| 1104 → 0 | 0.02 | 0.00 | 0 | 0.00 | 0 | 0.00 | 0.00 | 0.00 | 0.00 | 0.00 | 0.00 | 1102 |
| 1106 → 0 | 0.00 | 0.00 | 0 | 0.00 | 0 | 0.00 | 0.00 | 0.00 | 0.00 | 0.00 | 0.00 | 1102 |
| 1108 → 0 | 0.01 | 0.00 | 0 | 0.00 | 0 | 0.00 | 0.00 | 0.00 | 0.00 | 0.00 | 0.00 | 1102 |
| 0 | −0.02 | 0.00 | 0 | 0.00 | 0 | 0.00 | 0.00 | 0.00 | 0.00 | 0.00 | 0.00 | 1102 |
| 0 | −0.02 | 0.00 | 0 | 0.00 | 0 | 0.00 | 0.00 | 0.00 | 0.00 | 0.00 | 0.00 | 1122 |
| 0 | 0.03 | 0.00 | 0 | 0.00 | 0 | 0.00 | 0.00 | 0.00 | 0.00 | 0.00 | 0.00 | 1122 |
| 0 | −0.05 | 0.00 | 0 | 0.00 | 0 | 0.00 | 0.00 | 0.00 | 0.00 | 0.00 | 0.00 | 1122 |
| 0 | 0.03 | 0.00 | 0 | 0.00 | 0 | 0.00 | 0.00 | 0.00 | 0.00 | 0.00 | 0.00 | 1122 |
| 0 | 0.03 | 0.00 | 0 | 0.00 | 0 | 0.00 | 0.00 | 0.00 | 0.00 | 0.00 | 0.00 | 1122 |
| 0 | 0.02 | 0.00 | 0 | 0.00 | 0 | 0.00 | 0.00 | 0.00 | 0.00 | 0.00 | 0.00 | 1122 |
| 0 | −0.05 | 0.00 | 0 | 0.00 | 0 | 0.00 | 0.00 | 0.00 | 0.00 | 0.00 | 0.00 | 1122 |
| 0 | −0.01 | 0.00 | 0 | 0.00 | 0 | 0.00 | 0.00 | 0.00 | 0.00 | 0.00 | 0.00 | 1122 |
| 0 | 0.04 | 0.00 | 0 | 0.00 | 0 | .00 | 0.00 | 0.00 | 0.00 | 0.00 | 0.00 | 1122 |
| 0 | 0.03 | 0.00 | 0 | 0.00 | 0 | 0.00 | 0.00 | 0.00 | 0.00 | 0.00 | 0.00 | 1122 |
| 0 | −0.01 | 0.00 | 0 | 0.00 | 0 | 0.00 | 0.00 | 0.00 | 0.00 | 0.00 | 0.00 | 1122 |
| 0 | 0.05 | 0.00 | 0 | 0.00 | 0 | 0.00 | 0.00 | 0.00 | 0.00 | 0.00 | 0.00 | 1122 |
| 0 | 0.04 | 0.00 | 0 | 0.00 | 0 | 0.00 | 0.00 | 0.00 | 0.00 | 0.00 | 0.00 | 1122 |
| −1 | −1.04 | 0.00 | −1 | −1.00 | 0 | 0.08 | −0.00 | −0.00 | 0.00 | −0.00 | −0.00⊛ | 1126 ← 1124 |
| −1 | −1.62 | −0.13 | −1 | −0.87 | 0 | 0.20 | 0.07 | −0.01 | −0.00 | −0.00 | −0.00* | ← 1128 |
| 0 | −0.82 | −0.27 | 0 | 0.27 | 0 | 0.18 | 0.04 | −0.03 | −0.00 | −0.00 | −0.01 | |
| 0 | −0.15 | −0.01 | 0 | 0.01 | 0 | 01.8 | 0.03 | −0.03 | −0.00 | −0.00 | −0.01 | |
| 0 | 0.03 | 0.03 | 0 | −0.03 | 0 | 01.8 | 0.03 | −0.03 | 0.00 | 0.00 | −0.01 | |
| 1 | 0.96 | 0.18 | 1 | 0.82 | 0 | 0.24 | 0.04 | −0.04 | −0.05 | −0.10 | −0.07* | |
| −1 | −0.33 | 0.17 | −1 | −1.17 | 0 | 0.27 | −0.05 | −0.04 | −0.04 | −0.03 | 0.08* | |
| −1 | −1.51 | −0.49 | −1 | −0.51 | 0 | 0.33 | −0.04 | −0.08 | −0.04 | −0.02 | 0.11* | |
| 0 | −0.83 | −0.25 | 0 | 0.25 | 0 | 0.32 | −0.07 | −0.09 | −0.02 | −0.02 | 0.11 | |
| 0 | −0.14 | 0.13 | 0 | −0.13 | 0 | 0.32 | −0.06 | −0.07 | −0.02 | −0.03 | 0.11 | |
| 0 | 0.01 | 0.21 | 0 | −0.21 | 0 | 0.32 | −0.06 | −0.06 | 0.01 | −0.03 | 0.09 | |
| 1 | 0.98 | 0.32 | 1 | 0.68 | 0 | 0.37 | −0.06 | −0.06 | −0.04 | −0.11 | 0.07* | |
| −1 | −0.36 | −0.21 | −1 | −0.79 | 0 | 0.39 | −0.12 | −0.06 | −0.03 | −0.06 | 0.17* | |
| −1 | −1.48 | −0.73 | −1 | −0.27 | −1 | 0.43 | −0.11 | −0.08 | −0.03 | −0.05 | 0.19 | |
| 0 | −0.78 | −0.19 | 0 | 0.19 | 0 | 0.41 | −0.13 | −0.09 | −0.01 | −0.05 | 0.18 | |
| 0 | −0.14 | 0.14 | 0 | −0.14 | 0 | 0.42 | −0.13 | −0.07 | −0.01 | −0.06 | 0.18 | |
| 0 | 0.05 | 0.31 | 0 | −0.31 | 0 | 0.41 | −0.12 | −0.05 | 0.03 | −0.05 | 0.16 | |
| 1 | 1.04 | 0.43 | 1 | 0.57 | 0 | 0.46 | −0.12 | −0.06 | −0.01 | −0.12 | 0.14* | |
| −1 | −0.37 | −0.41 | −1 | −0.59 | 0 | 0.48 | −0.17 | −0.06 | −0.00 | −0.08 | 0.21* | |
| −1 | −1.49 | −0.87 | −1 | −0.13 | −1 | 0.49 | −0.16 | −0.07 | −0.00 | −0.08 | 0.22 | |
| 0 | −0.76 | −0.14 | 0 | 0.14 | 0 | 0.49 | −0.18 | −0.08 | 0.01 | −0.08 | 0.22 | |
| 0 | −0.18 | 0.09 | 0 | −0.09 | 0 | 0.49 | −0.18 | −0.07 | 0.01 | −0.09 | 0.22 | |
| 0 | 0.00 | 0.33 | 0 | −0.33 | 0 | 0.49 | −0.17 | −0.05 | 0.05 | −0.08 | 0.19 | |
| 1 | 0.96 | 0.49 | 1 | 0.51 | 0 | 0.53 | −0.17 | −0.05 | 0.02 | −0.14 | 0.18* | |
| −1 | −0.29 | −0.48 | −1 | −0.52 | 0 | 0.54 | −0.21 | −0.05 | 0.03 | −0.11 | 0.24* | ← 1130 |
| −1 | −1.49 | −0.96 | −1 | −0.04 | −1 | 0.54 | −0.21 | −0.06 | 0.03 | −0.11 | 0.24 | |
| 0 | −0.86 | −0.15 | 0 | 0.15 | 0 | 0.53 | −0.23 | −0.06 | 0.04 | −0.11 | 0.24 | |
| 0 | −0.14 | 0.10 | 0 | −0.10 | 0 | 0.53 | −0.22 | −0.05 | 0.04 | −0.12 | 0.24 | |
| 0 | −0.04 | 0.26 | 0 | −0.26 | 0 | 0.53 | −0.22 | −0.03 | 0.07 | −0.11 | 0.22 | |
| 1 | 0.96 | 0.57 | 1 | 0.43 | 1 | 0.57 | −0.22 | −0.04 | 0.04 | −0.16 | 0.21 | |
| −1 | −0.31 | −0.57 | −1 | −0.43 | −1 | 0.58 | −0.25 | −0.04 | 0.05 | −0.13 | 0.26 | |
| −1 | −1.53 | −1.05 | −1 | 0.05 | −1 | 0.57 | −0.26 | −0.03 | 0.05 | −0.13 | 0.26 | |
| 0 | −0.86 | −0.08 | 0 | 0.08 | 0 | 0.57 | −0.26 | −0.03 | 0.05 | −0.13 | 0.26 | |
| 0 | −0.17 | 0.03 | 0 | −0.03 | 0 | 0.57 | −0.26 | −0.03 | 0.05 | −0.14 | 0.26 | |
| 0 | −0.01 | 0.27 | 0 | −0.27 | 0 | 0.57 | −0.26 | −0.01 | 0.09 | −0.13 | 0.24 | |
| 1 | 0.98 | 0.61 | 1 | 0.39 | 1 | 0.60 | −0.26 | −0.02 | 0.06 | −0.18 | 0.23 | |
| −1 | −0.30 | −0.64 | −1 | −0.36 | −1 | 0.61 | −0.29 | −0.02 | 0.06 | −0.15 | 0.27 | |
| −1 | −1.46 | −1.03 | −1 | 0.03 | −1 | 0.60 | −0.29 | −0.01 | 0.06 | −0.15 | 0.27 | |
| 0 | −0.82 | −0.05 | 0 | 0.05 | 0 | 0.60 | −0.29 | −0.02 | 0.07 | −0.15 | 0.27 | |
| 0 | −0.17 | −0.01 | 0 | 0.01 | 0 | 0.60 | −0.29 | −0.02 | 0.07 | −0.15 | 0.27 | |

TABLE 1-continued

| | | | | | | | | | | | |
|---|---|---|---|---|---|---|---|---|---|---|---|
| 0 | −0.03 | 0.25 | 0 | −0.25 | 0 | 0.60 | −0.29 | −0.00 | 0.10 | −0.14 | 0.25 |
| 1 | 0.97 | 0.65 | 1 | 0.35 | 1 | 0.63 | −0.29 | −0.01 | 0.07 | −0.19 | 0.24 |
| −1 | −0.033 | −0.70 | −1 | −0.30 | −1 | 0.64 | −0.32 | −0.00 | 0.08 | −0.17 | 0.28 |
| −1 | −1.52 | −1.07 | −1 | 0.07 | −1 | 0.63 | −0.32 | 0.00 | 0.08 | −0.17 | 0.27 |
| 0 | −0.82 | 0.00 | 0 | −0.00 | 0 | 0.63 | −0.32 | 0.00 | 0.08 | −0.17 | 0.27 |
| 0 | −0.13 | −0.02 | 0 | 0.02 | 0 | 0.63 | −0.32 | −0.00 | 0.08 | −0.17 | 0.27 |
| 0 | −0.02 | 0.23 | 0 | −0.23 | 0 | 0.63 | −0.32 | 0.01 | 0.11 | −0.16 | 0.25 |
| 1 | 1.01 | 0.71 | 1 | 0.29 | 1 | 0.65 | −0.32 | 0.01 | 0.09 | −0.19 | 0.25 |
| −1 | −0.37 | −0.79 | −1 | −0.21 | −1 | 0.66 | −0.33 | 0.01 | 0.09 | −0.18 | 0.27 |
| −1 | −1.54 | −1.08 | −1 | 0.08 | −1 | 0.65 | −0.34 | 0.02 | 0.09 | −0.18 | 0.27 |
| 0 | −0.80 | 0.05 | 0 | −0.05 | 0 | 0.65 | −0.33 | 0.02 | 0.09 | −0.18 | 0.27 |
| 0 | −0.19 | −0.11 | 0 | 0.11 | 0 | 0.65 | −0.34 | 0.01 | 0.08 | −0.17 | 0.27 |
| 0 | −0.00 | 0.27 | 0 | −0.27 | 0 | 0.65 | −0.33 | 0.02 | 0.11 | −0.16 | 0.25 |
| 1 | 1.04 | 0.74 | 1 | 0.26 | 1 | 0.67 | −0.33 | 0.02 | 0.10 | −0.20 | 0.24 |
| −1 | −0.36 | −0.82 | −1 | −0.18 | −1 | 0.68 | −0.35 | 0.02 | 0.10 | −0.18 | 0.26 |
| −1 | −1.48 | −1.03 | −1 | 0.03 | −1 | 0.67 | −0.35 | 0.02 | 0.10 | −0.19 | 0.26 |
| 0 | −0.82 | 0.01 | 0 | −0.01 | 0 | 0.67 | −0.35 | 0.02 | 0.10 | −0.19 | 0.26 |
| 0 | −0.17 | −0.09 | 0 | 0.09 | 0 | 0.67 | −0.35 | 0.01 | 0.10 | −0.18 | 0.26 |
| 0 | 0.04 | 0.27 | 0 | −0.27 | 0 | 0.67 | −0.35 | 0.03 | 0.13 | −0.17 | 0.24 |
| 1 | 1.01 | 0.72 | 1 | 0.28 | 1 | 0.69 | −0.35 | 0.02 | 0.11 | −0.20 | 0.23 |
| −1 | −0.33 | −0.77 | −1 | −0.23 | −1 | 0.70 | −0.37 | 0.02 | 0.11 | −0.19 | 0.26 |
| −1 | −1.52 | −1.09 | −1 | 0.09 | −1 | 0.69 | −0.37 | 0.03 | 0.11 | −0.19 | 0.25 |
| 0 | −0.85 | 0.03 | 0 | −0.03 | 0 | 0.69 | −0.37 | 0.03 | 0.11 | −0.19 | 0.25 |
| 0 | −0.14 | −0.05 | 0 | 0.05 | 0 | 0.69 | −0.37 | 0.03 | 0.11 | −0.18 | 0.25 |
| 0 | 0.02 | 0.19 | 0 | −0.19 | 0 | 0.69 | −0.37 | 0.04 | 0.13 | −0.18 | 0.23 |
| 1 | 1.04 | 0.79 | 1 | 0.21 | 1 | 0.71 | −0.37 | 0.04 | 0.12 | −0.21 | 0.23 |
| −1 | −0.31 | −0.79 | −1 | −0.21 | −1 | 0.71 | −0.38 | 0.04 | 0.12 | −0.19 | 0.25 |
| −1 | −1.56 | −1.14 | −1 | 0.14 | −1 | 0.70 | −0.39 | 0.05 | 0.12 | −0.19 | 0.24 |
| 0 | −0.81 | 0.12 | 0 | −0.12 | 0 | 0.70 | −0.37 | 0.05 | 0.11 | −0.19 | 0.25 |
| 0 | −0.11 | −0.08 | 0 | 0.08 | 0 | 0.70 | −0.38 | 0.04 | 0.11 | −0.19 | 0.25 |
| 0 | −0.01 | 0.15 | 0 | −0.15 | 0 | 0.70 | −0.38 | 0.05 | 0.13 | −0.18 | 0.23 |
| 1 | 1.02 | 0.82 | 1 | 0.18 | 1 | 0.72 | −0.38 | 0.05 | 0.12 | −0.20 | 0.23 |
| −1 | −0.34 | −0.83 | −1 | −0.17 | −1 | 0.72 | −0.39 | 0.05 | 0.12 | −0.19 | 0.25 |
| −1 | −1.51 | −1.09 | −1 | 0.09 | −1 | 0.71 | −0.39 | 0.05 | 0.12 | −0.19 | 0.24 |
| 0 | −0.81 | 0.09 | 0 | −0.09 | 0 | 0.72 | −0.38 | 0.06 | 0.11 | −0.19 | 0.25 |
| 0 | −0.16 | −0.13 | 0 | 0.13 | 0 | 0.71 | −0.39 | 0.04 | 0.11 | −0.18 | 0.25 |
| 0 | −0.01 | 0.17 | 0 | −0.17 | 0 | 0.71 | −0.39 | 0.05 | 0.13 | −0.18 | 0.23 |
| 1 | 0.98 | 0.78 | 1 | 0.22 | 1 | 0.73 | −0.39 | 0.05 | 0.11 | −0.21 | 0.23 |
| −1 | −0.38 | −0.85 | −1 | −0.15 | −1 | 0.74 | −0.40 | 0.05 | 0.12 | −0.20 | 0.24 |
| −1 | −1.54 | −1.09 | −1 | 0.09 | −1 | 0.72 | −0.40 | 0.06 | 0.12 | −0.20 | 0.24 |
| 0 | −0.76 | 0.12 | 0 | −0.12 | 0 | 0.73 | −0.39 | 0.06 | 0.11 | −0.20 | 0.24 |
| 0 | −0.19 | −0.18 | 0 | 0.18 | 0 | 0.73 | −0.40 | 0.04 | 0.10 | −0.18 | 0.24 |
| 0 | −0.01 | 0.19 | 0 | −0.19 | 0 | 0.73 | −0.40 | 0.05 | 0.12 | −0.18 | 0.22 |
| 1 | 0.99 | 0.81 | 1 | 0.19 | 1 | 0.74 | −0.40 | 0.05 | 0.11 | −0.20 | 0.22 |
| −1 | −0.34 | −0.85 | −1 | −0.15 | −1 | 0.75 | −0.41 | 0.05 | 0.11 | −0.19 | 0.24 |
| −1 | −1.54 | −1.11 | −1 | 0.11 | −1 | 0.74 | −0.41 | 0.06 | 0.11 | −0.19 | 0.23 |
| 0 | −0.81 | 0.09 | 0 | −0.09 | 0 | 0.74 | −0.40 | 0.06 | 0.11 | −0.19 | 0.23 |
| 0 | −0.17 | −0.13 | 0 | 0.13 | 0 | 0.74 | −0.41 | 0.04 | 0.10 | −0.18 | 0.23 |
| 0 | 0.01 | 0.17 | 0 | −0.17 | 0 | 0.74 | −0.41 | 0.06 | 0.13 | −0.18 | 0.22 |
| 1 | 1.00 | 0.83 | 1 | 0.17 | 1 | 0.75 | −0.41 | 0.05 | 0.11 | −0.20 | 0.21 |
| −1 | −0.37 | −0.98 | −1 | −0.13 | −1 | 0.76 | −0.42 | 0.05 | 0.12 | −0.19 | 0.23 |
| −1 | −1.47 | −1.05 | −1 | 0.05 | −1 | 0.75 | −0.42 | 0.06 | 0.12 | −0.19 | 0.22 |
| 0 | −0.79 | 0.07 | 0 | −0.07 | 0 | 0.76 | −0.41 | 0.06 | 0.11 | −0.19 | 0.23 |
| 0 | −0.15 | −0.11 | 0 | 0.11 | 0 | 0.75 | −0.42 | 0.05 | 0.11 | −0.18 | 0.23 |
| 0 | −0.01 | 0.16 | 0 | −0.16 | 0 | 0.75 | −0.41 | 0.06 | 0.13 | −0.18 | 0.21 |
| 1 | 0.96 | 0.80 | 1 | 0.20 | 1 | 0.77 | −0.41 | 0.05 | 0.11 | −0.20 | 0.21 |
| −1 | −0.31 | −0.80 | −1 | −0.20 | −1 | 0.77 | −0.43 | 0.05 | 0.12 | −0.19 | 0.23 |
| −1 | −1.51 | −1.14 | −1 | 0.14 | −1 | 0.76 | −0.43 | 0.07 | 0.12 | −0.19 | 0.22 |
| 0 | −0.78 | 0.12 | 0 | −0.12 | 0 | 0.76 | −0.42 | 0.07 | 0.11 | −0.19 | 0.22 |
| 0 | −0.14 | −0.10 | 0 | 0.10 | 0 | 0.76 | −0.43 | 0.06 | 0.10 | −0.18 | 0.22 |
| 0 | 0.03 | 0.16 | 0 | −0.16 | 0 | 0.76 | −0.42 | 0.07 | 0.12 | −0.18 | 0.21 |
| 1 | 0.95 | 0.81 | 1 | 0.19 | 1 | 0.78 | −0.42 | 0.06 | 0.11 | −0.20 | 0.21 |
| −1 | −0.37 | −0.86 | −1 | −0.14 | −1 | 0.78 | −0.43 | 0.06 | 0.11 | −0.19 | 0.22 |
| −1 | −1.55 | −1.14 | −1 | 0.14 | −1 | 0.76 | −0.44 | 0.07 | 0.11 | −0.20 | 0.22 |
| 0 | −0.85 | 0.07 | 0 | −0.07 | 0 | 0.77 | −0.43 | 0.08 | 0.11 | −0.20 | 0.22 |
| 0 | −0.17 | −0.10 | 0 | 0.10 | 0 | 0.77 | −0.44 | 0.06 | 0.10 | −0.19 | 0.22 |
| 0 | −0.04 | 0.10 | 0 | −0.10 | 0 | 0.77 | −0.43 | 0.07 | 0.12 | −0.18 | 0.21 |
| 12 | 0.95 | 0.84 | 1 | 0.16 | 1 | 0.78 | −0.43 | 0.07 | 0.11 | −0.20 | 0.20 |
| −1 | −0.34 | −0.84 | −1 | −0.16 | −1 | 0.78 | −0.45 | 0.07 | 0.11 | −0.19 | 0.22 |
| −1 | −1.49 | −1.12 | −1 | 0.12 | −1 | 0.77 | −0.45 | 0.08 | 0.11 | −0.19 | 0.22 |
| 0 | −0.81 | 0.10 | 0 | −0.10 | 0 | 0.78 | −0.44 | 0.08 | 0.10 | −0.19 | 0.22 |
| 0 | −0.12 | −0.09 | 0 | 0.09 | 0 | 0.78 | −0.44 | 0.07 | 0.10 | −0.19 | 0.22 |
| 0 | −0.04 | 0.09 | 0 | −0.09 | 0 | 0.78 | −0.44 | 0.08 | 0.11 | −0.19 | 0.21 |
| 1 | 0.97 | 0.88 | 1 | 0.12 | 1 | 0.79 | −0.44 | 0.07 | 0.10 | −0.20 | 0.21 |
| −1 | −0.32 | −0.85 | −1 | −0.15 | −1 | 0.79 | −0.46 | 0.08 | 0.10 | −0.19 | 0.23 |
| −1 | −1.51 | −1.14 | −1 | 0.14 | −1 | 0.77 | −0.46 | 0.09 | 0.10 | −0.19 | 0.22 |
| 0 | −0.82 | 0.11 | 0 | −0.11 | 0 | 0.78 | −0.45 | 0.09 | 0.09 | −0.19 | 0.22 |
| 0 | −0.19 | −0.14 | 0 | 0.14 | 0 | 0.78 | −0.45 | 0.07 | 0.09 | −0.18 | 0.22 |
| 0 | 0.02 | 0.17 | 0 | −0.17 | 0 | 0.78 | −0.45 | 0.08 | 0.11 | −0.18 | 0.20 |

TABLE 1-continued

| | | | | | | | | | | | | |
|---|---|---|---|---|---|---|---|---|---|---|---|---|
| 1 | 1.04 | 0.90 | 1 | 0.10 | 1 | 0.79 | −0.45 | 0.08 | 0.10 | −0.19 | 0.20 | |
| −1 | −0.34 | −0.90 | −1 | −0.10 | −1 | 0.79 | −0.46 | 0.08 | 0.11 | −0.18 | 0.21 | |
| −1 | −1.55 | −1.12 | −1 | 0.12 | −1 | 0.77 | −0.46 | 0.09 | 0.11 | −0.18 | 0.20 | |
| 0 | −0.78 | 0.15 | 0 | −0.15 | 0 | 0.78 | −0.44 | 0.10 | 0.09 | −0.18 | 0.21 | |
| −1 | −1.15 | −0.92 | — | −0.08 | −1 | 0.79 | −0.44 | 0.11 | 0.10 | −0.19 | 0.21 | ← 1129 |
| −1 | −1.69 | −0.78 | — | −0.22 | −1 | 0.82 | −0.42 | 0.12 | 0.12 | −0.18 | 0.19 | |
| −1 | −1.85 | −0.82 | — | −0.18 | −1 | 0.85 | −0.40 | 0.14 | 0.13 | −0.16 | 0.19 | |
| 0 | −0.84 | −0.54 | — | −0.46 | −1 | 0.88 | −0.33 | 0.20 | 0.18 | −0.13 | 0.28* | |
| 0 | −0.19 | −0.60 | — | −0.40 | −1 | 0.88 | −0.30 | 0.26 | 0.23 | −0.10 | 0.28* | |
| −1 | −1.02 | −1.65 | — | 0.65 | −1 | 0.83 | −0.31 | 0.21 | 0.13 | −0.18 | 0.22 | |
| 0 | −0.63 | −0.39 | — | 0.39 | 0 | 0.81 | −0.34 | 0.21 | 0.11 | −0.24 | 0.16 | |
| 1 | 0.87 | 0.59 | — | 0.41 | 1 | 0.84 | −0.36 | 0.17 | 0.10 | −0.27 | 0.10 | |
| 1 | 1.62 | 0.79 | — | 0.21 | 1 | 0.87 | −0.35 | 0.16 | 0.09 | −0.27 | 0.09 | |
| 1 | 1.79 | 1.34 | — | −0.34 | 1 | 0.82 | −0.39 | 0.14 | 0.10 | −0.24 | 0.09 | |
| 0 | 0.79 | 0.32 | — | −0.32 | 0 | 0.80 | −0.44 | 0.10 | 0.08 | −0.23 | 0.12 | |
| −1 | −0.85 | −0.99 | — | −0.01 | −1 | 0.80 | −0.44 | 0.10 | 0.08 | −0.23 | 0.12 | |
| −1 | −1.68 | −1.10 | — | 0.01 | −1 | 0.80 | −0.44 | 0.10 | 0.08 | −0.23 | 0.12 | |
| −1 | −1.81 | −0.94 | — | −0.06 | −1 | 0.81 | −0.43 | 0.10 | 0.08 | −0.24 | 0.11 | |
| −1 | −1.77 | −0.87 | — | −0.13 | −1 | 0.82 | −0.41 | 0.12 | 0.09 | −0.24 | 0.09 | |
| 0 | −0.78 | 0.01 | — | −0.01 | 0 | 0.82 | −0.41 | 0.12 | 0.09 | −0.24 | 0.09 | |
| 0 | −0.17 | 0.14 | — | −0.14 | 0 | 0.83 | −0.40 | 0.14 | 0.11 | −0.23 | 0.10 | |
| 0 | −0.04 | −0.03 | — | 0.03 | 0 | 0.83 | −0.40 | 0.14 | 0.10 | −0.23 | 0.10 | |
| 0 | −0.01 | 0.13 | — | −0.13 | 0 | 0.83 | −0.40 | 0.14 | 0.11 | −0.21 | 0.12 | |
| 0 | −0.04 | −0.10 | — | 0.10 | 0 | 0.83 | −0.40 | 0.14 | 0.11 | −0.22 | 0.10 | |
| 0 | 0.01 | −0.03 | — | 0.03 | 0 | 0.83 | −0.40 | 0.14 | 0.11 | −0.22 | 0.10 | |
| −1 | −1.04 | −0.87 | — | −0.13 | −1 | 0.84 | −0.40 | 0.14 | 0.11 | −0.22 | 0.10 | |
| −1 | −1.69 | −1.00 | — | −0.00 | −1 | 0.84 | −0.40 | 0.14 | 0.11 | −0.22 | 0.10 | |
| 0 | −0.85 | −0.17 | — | 0.17 | 0 | 0.83 | −0.43 | 0.13 | 0.11 | −0.22 | 0.10 | |
| 1 | 0.83 | 0.71 | — | 0.29 | 1 | 0.84 | −0.44 | 0.09 | 0.09 | −0.22 | 0.10 | |
| 0 | 0.70 | 0.23 | — | −0.23 | 0 | 0.83 | −0.46 | 0.10 | 0.12 | −0.20 | 0.10 | |
| 0 | 0.14 | 0.01 | — | −0.01 | 0 | 0.83 | −0.46 | 0.10 | 0.12 | −0.20 | 0.10 | |
| 0 | 0.03 | 0.12 | — | −0.12 | 0 | 0.83 | −0.46 | 0.10 | 0.11 | −0.19 | 0.12 | |
| 0 | 0.02 | −0.17 | — | 0.17 | 0 | 0.83 | −0.46 | 0.10 | 0.12 | −0.18 | 0.11 | |
| 0 | −0.02 | −0.04 | — | 0.04 | 0 | 0.83 | −0.46 | 0.10 | 0.12 | −0.18 | 0.11 | |
| −1 | −1.01 | −0.77 | — | −0.23 | −1 | 0.85 | −0.46 | 0.10 | 0.12 | −0.18 | 0.10 | |
| 0 | −0.69 | −0.11 | — | 0.11 | 0 | 0.84 | −0.47 | 0.10 | 0.12 | −0.18 | 0.10 | |
| 1 | 0.85 | 0.94 | — | 0.06 | 1 | 0.85 | −0.47 | 0.09 | 0.12 | −0.18 | 0.10 | |
| 0 | 0.66 | −0.02 | — | 0.02 | 0 | 0.85 | −0.47 | 0.09 | 0.12 | −0.18 | 0.10 | |
| −1 | −0.85 | −0.86 | — | −0.14 | −1 | 0.86 | −0.48 | 0.08 | 0.12 | −0.17 | 0.10 | |
| −1 | −1.65 | −0.83 | — | −0.17 | −1 | 0.88 | −0.47 | 0.07 | 0.11 | −0.16 | 0.11 | |
| −1 | −1.79 | −1.01 | — | 0.01 | −1 | 0.88 | −0.47 | 0.07 | 0.11 | −0.16 | 0.11 | |
| 0 | −0.82 | −0.11 | — | 0.11 | 0 | 0.87 | −0.48 | 0.06 | 0.11 | −0.15 | 0.12 | |
| 1 | 0.83 | 1.05 | — | −0.05 | 1 | 0.87 | −0.48 | 0.07 | 0.11 | −0.15 | 0.12 | |
| 1 | 1.66 | 0.93 | — | 0.07 | 1 | 0.88 | −0.48 | 0.06 | 0.10 | −0.16 | 0.11 | |
| 1 | 1.82 | 0.86 | — | 0.14 | 1 | 0.90 | −0.46 | 0.07 | 0.09 | −0.18 | 0.10 | |
| 1 | 1.85 | 0.99 | — | 0.01 | 1 | 0.90 | −0.46 | 0.07 | 0.09 | −0.18 | 0.10 | |
| 1 | 1.78 | 0.82 | — | 0.18 | 1 | 0.92 | −0.43 | 0.10 | 0.12 | −0.16 | 0.08 | |
| 0 | 0.83 | 0.20 | — | −0.20 | 0 | 0.91 | −0.46 | 0.07 | 0.09 | −0.19 | 0.07 | |
| 0 | 0.18 | −0.16 | — | 0.16 | 0 | 0.91 | −0.45 | 0.09 | 0.11 | −0.17 | 0.09 | |
| 1 | 1.03 | 1.00 | — | 0.00 | 1 | 0.91 | −0.45 | 0.09 | 0.11 | −0.17 | 0.09 | |
| 1 | 1.71 | 1.08 | — | −0.08 | 1 | 0.90 | −0.45 | 0.09 | 0.11 | −0.18 | 0.08 | |
| 1 | 1.77 | 0.93 | — | 0.07 | 1 | 0.91 | −0.44 | 0.10 | 0.11 | −0.17 | 0.09 | |
| 0 | 0.80 | 0.27 | — | −0.27 | 0 | 0.90 | −0.48 | 0.06 | 0.09 | −0.18 | 0.07 | |
| −1 | −0.89 | −1.09 | — | 0.09 | −1 | 0.89 | −0.48 | 0.07 | 0.10 | −0.17 | 0.07 | |
| −1 | −1.69 | −1.06 | — | 0.06 | −1 | 0.88 | −0.48 | 0.08 | 0.11 | −0.16 | 0.08 | |
| −1 | −1.79 | −0.90 | — | 0.10 | −1 | 0.90 | −0.47 | 0.09 | 0.10 | −0.18 | 0.06 | |
| 0 | −0.80 | −0.15 | — | 0.15 | 0 | 0.89 | −0.49 | 0.07 | 0.09 | −0.17 | 0.09 | |
| 1 | 0.85 | 1.09 | — | −0.09 | 1 | 0.88 | −0.48 | 0.08 | 0.10 | −0.16 | 0.08 | |
| 0 | 0.069 | 0.15 | — | −0.15 | 0 | 0.87 | −0.49 | 0.09 | 0.12 | −0.14 | 0.09 | |
| −1 | −0.81 | −0.97 | — | −0.03 | −1 | 0.87 | −0.49 | 0.09 | 0.12 | −0.14 | 0.09 | |
| 0 | −0.70 | −0.11 | — | 0.11 | 0 | 0.87 | −0.50 | 0.09 | 0.13 | −0.14 | 0.08 | |
| 0 | −0.13 | 0.07 | — | −0.07 | 0 | 0.87 | −0.50 | 0.10 | 0.13 | −0.15 | 0.08 | |
| −1 | −1.01 | −1.10 | — | 0.01 | −1 | 0.87 | −0.50 | 0.09 | 0.13 | −0.15 | 0.08 | |
| −1 | −1.68 | −0.89 | — | −0.11 | −1 | 0.88 | −0.49 | 0.10 | 0.14 | −0.14 | 0.08 | |
| 0 | −0.78 | 0.05 | — | −0.05 | 0 | 0.89 | −0.48 | 0.10 | 0.14 | −0.14 | 0.08 | |
| 0 | −0.16 | −0.11 | — | 0.11 | 0 | 0.89 | −0.49 | 0.09 | 0.13 | −0.14 | 0.08 | |
| 0 | −0.02 | −0.09 | — | 0.09 | 0 | 0.89 | −0.49 | 0.08 | 0.11 | −0.15 | 0.07 | |
| 1 | 0.99 | 0.96 | — | 0.04 | 1 | 0.89 | −0.49 | 0.08 | 0.11 | −0.15 | 0.07 | |
| 0 | 0.62 | 0.05 | — | −0.05 | 0 | 0.89 | −0.49 | 0.08 | 0.11 | −0.15 | 0.08 | |
| 0 | 0.13 | −0.15 | — | 0.15 | 0 | 0.89 | −0.48 | 0.09 | 0.11 | −0.15 | 0.07 | |
| 1 | 0.97 | 0.95 | — | 0.05 | 1 | 0.89 | −0.48 | 0.09 | 0.12 | −0.15 | 0.07 | |
| 1 | 1.65 | 0.94 | — | 0.06 | 1 | 0.90 | −0.48 | 0.09 | 0.12 | −0.15 | 0.07 | |
| 0 | 0.81 | 0.02 | — | −0.02 | 0 | 0.90 | −0.48 | 0.09 | 0.12 | −0.15 | 0.07 | |
| −1 | −0.80 | −0.83 | — | −0.17 | −1 | 0.91 | −0.49 | 0.07 | 0.11 | −0.15 | 0.06 | |
| −1 | −1.67 | −1.03 | — | 0.03 | −1 | 0.91 | −0.50 | 0.07 | 0.11 | −0.15 | 0.06 | |
| −1 | −1.83 | −0.98 | — | −0.02 | −1 | 0.91 | −0.49 | 0.07 | 0.11 | −0.15 | 0.06 | |
| 0 | −0.85 | −0.10 | — | 0.10 | 0 | 0.90 | −0.51 | 0.06 | 0.10 | −0.14 | 0.07 | |
| 0 | −0.10 | 0.23 | — | −0.23 | 0 | 0.90 | −0.49 | 0.09 | 0.13 | −0.13 | 0.05 | |
| 0 | 0.04 | −0.06 | — | 0.06 | 0 | 0.90 | −0.49 | 0.09 | 0.12 | −0.14 | 0.05 | |

TABLE 1-continued

| | | | | | | | | | | | |
|---|---|---|---|---|---|---|---|---|---|---|---|
| 0 | −0.01 | 0.03 | — | −0.03 | 0 | 0.90 | −0.49 | 0.09 | 0.12 | −0.13 | 0.05 |
| 0 | −0.04 | −0.03 | — | 0.03 | 0 | 0.90 | −0.49 | 0.09 | 0.12 | −0.13 | 0.05 |
| 0 | 0.02 | 0.02 | — | −0.02 | 0 | 0.90 | −0.49 | 0.09 | 0.12 | −0.13 | 0.05 |

What is claimed is:

1. A wireline logging telemetry system with improved initialization characteristics, comprising:

(a) a sonde including a training sequence transmitter to repeatedly transmit a specified periodic pseudorandom training sequence with a repeating pattern, wherein the pattern includes a selected number of symbols; and (b) a surface modem operatively coupled to the sonde, programmed to perform initialization steps comprising:

(1) generating a digital signal by receiving and digitizing the training sequence sent by the transmitter;

(2) sequentially advancing the digital signals into a finite impulse response filter-equalizer to provide a filter-equalizer output signal, wherein the filter-equalizer includes a set of adjustable coefficient signals equal in number to the selected number of symbols in the repeating pattern of the training sequence;

(3) generating the training sequence independent of the transmitter to form a generator output signal; and (4) adapting the coefficient signals of the filter-equalizer in response to the digital signal and the difference between the generator output signal and the filter-equalizer output signal.

2. The system of claim 1, wherein operation of the training sequence transmitter is initiated upon power up.

3. The system of claim 1, wherein operation of the training sequence transmitter is initiated when the sonde receives a specified signal from the surface modem.

4. The system of claim 1, further including a multiconductor cable electrically connecting the sonde and the surface modem.

5. The system of claim 1, further including a monocable electrically connecting the sonde and the surface modem.

6. The system of claim 1, wherein the surface modem is further programmed to adapt the coefficient signals at a rate that is responsive to a specified sensitivity constant.

7. The system of claim 1, wherein the surface modem is further programmed to adapt each particular coefficient signal of the filter-equalizer as follows:

$$C_{new}=C_{old}+\beta*ERR*DV,$$

wherein, $C_{new}$ represents a new version of the particular coefficient signal, $C_{old}$ represents a previous version of the particular coefficient signal, ERR corresponds to the difference between the generator output signal and the filter-equalizer output signal, and DV corresponds to a portion of the digital signal advanced into the filter-equalizer that corresponds to the particular coefficient signal.

8. The system of claim 7, wherein the surface modem is further programmed to associate the filter-equalizer output signal with discrete signal values to provide a slicer output signal, and wherein the surface modem is also programmed to enter an operational mode at a selected time, in which the coefficient signals are adapted in response to the digital signal advanced into the filter-equalizer and the difference between the slicer output signal and the filter-equalizer output signal.

9. The system of claim 1, wherein the coefficient signals are initially set to zero.

10. The system of claim 1, wherein a selected number of the coefficient signals are adapted according to step (b)(4) between each said sequential advancement of step (b)(2).

11. The system of claim 1, wherein all of the coefficient signals are adapted according to step (b)(4) between each said sequential advancement of step (b)(2).

12. The system of claim 1, wherein only a selected number of digitized signals corresponding to received symbols are advanced into the filter-equalizer in step (b)(2) and the selected signals are rotated through the filter-equalizer rather than advancing newly received and digitized signals into the filter-equalizer.

13. The system of claim 12, wherein the selected number of digitized signals advanced into the filter-equalizer is equal to the number of symbols in the training sequence.

14. A system for initializing a wireline logging telemetry system, comprising:

a logging cable;

a sonde operatively coupled to the logging cable, including a training sequence transmitter to transmit a specified pseudorandom training sequence with a repeating pattern onto the logging cable, wherein the pattern includes a selected number of symbols;

an analog-to-digital converter operatively coupled to the logging cable to receive signals from the sonde over the logging cable and sequentially digitize the received signals;

an adaptive finite impulse response filter-equalizer coupled to the analog-to-digital converter, programmed to receive the digitized signals and provide a filter-equalizer output signal by applying coefficient signals to the digitized signals, wherein the coefficient signals are equal in number to the symbols in the training sequence, and wherein the coefficient signals are adapted in response to an error signal and the digitized signals;

a slicer to provide a sliced output signal by associating the filter-equalizer output signal with discrete signal levels;

a training sequence generator to provide a generated output signal identical in content to the training sequence of the transmitter, wherein the generator operates free from any synchronization with the transmitter;

a multiplexer to provide a multiplexer output signal that selectively comprises either the sliced output signal or the generated output signal; and an error unit to generate the error signal in response to the difference between the multiplexer output signal and the filter-equalizer output signal and direct the error signal to the filter-equalizer.

15. A method for initializing a wireline logging telemetry system, comprising steps of:

(a) using a transmitter to repeatedly transmit a specified pseudorandom training sequence on a wireline logging cable, wherein the sequence includes a selected number of symbols; and (b) receiving and digitizing signals sent by the transmitter over the logging cable;

(c) sequentially advancing the digitized signals into a finite impulse response filter-equalizer to provide a filter-equalizer output signal, wherein the filter-equalizer includes a selected number of taps and a set of adjustable coefficient signals equal in number to the symbols in the training sequence, wherein each coefficient signal is associated with a different tap;

(d) providing a generator output signal by repeatedly generating the pseudorandom training sequence at a generator output independent of the transmitter; and (e) adapting the coefficient signals of the filter-equalizer in response to the digitized signals advanced into the filter-equalizer and the difference between the generator output signal and the filter-equalizer output signal.

16. The method of claim 15, wherein each particular coefficient signal in step (e) is adapted according to the following relationship:

$$C_{new}=C_{old}+\beta*ERR*DV,$$

wherein, $C_{new}$ represents the particular coefficient signal as adapted, $C_{old}$ represents the particular coefficient signal prior to adapting, ERR corresponds to the difference between the generator output signal and the filter-equalizer output signal, and DV corresponds to a specified digitized signal advanced into the filter-equalizer that corresponds to the particular coefficient signal.

17. The method of claim 16, further including steps comprising:

(f) operating a slicer to provide a sliced output signal by associating the filter-equalizer output signal with discrete signal values; and (g) entering an operational mode at a selected time wherein ERR corresponds to the difference between the sliced output signal and the filter-equalizer output signal.

18. The method of claim 15, further including steps comprising:

(f) operating a slicer to provide a sliced output signal by associating the filter-equalizer output signal with discrete signal values; and (g) determining when the sliced output signal corresponds to the generator output signal.

19. The method of claim 15, further comprising a step of stabilizing the coefficient signals by continuing to perform steps (a) through (e) for a selected time.

20. The method of claim 17, wherein the selected time corresponds to a time at which the sliced output signal corresponds to the generator output signal.

21. The method of claim 17, wherein step (g) further comprises a step of shifting the coefficient signals with respect to the taps to associate the largest coefficient signal with a selected tap.

22. The method of claim 17, wherein step (g) further comprises a step of shifting the coefficient signals with respect to the taps to most efficiently adapt the filter-equalizer to an impulse response characteristic of the logging cable.

23. The system of claim 15, wherein only a selected number of digitized signals corresponding to received symbols are advanced into the filter-equalizer in step (c) and the selected signals are rotated through the filter-equalizer rather than advancing newly received and digitized signals into the filter-equalizer.

24. The method of claim 23, wherein the selected number of digitized signals advanced into the filter-equalizer is equal to the number of symbols in the training sequence.

25. A method for initializing a wireline logging telemetry system, comprising steps of:

(a) using a transmitter to repeatedly transmit a specified pseudorandom training sequence on a wireline logging cable, wherein the training sequence includes a selected number of symbols; and (b) generating a digitized signal by receiving and digitizing a selected segment of the training sequence sent by the transmitter;

(c) sequentially advancing the digitized signal into a finite impulse response filter-equalizer to provide a filter-equalizer output signal, wherein the filter-equalizer includes a selected number of taps and a set of adjustable coefficient signals equal in number to the symbols in the training sequence, wherein each coefficient signal is associated with a different tap;

(d) providing a generator output signal by repeatedly generating the training sequence independently of the transmitter, wherein the generator output signal is free from any intended synchronization with the transmitted training sequence;

(e) adapting the coefficient signals in response to the digitized signals advanced into the filter-equalizer and the difference between the generator output signal and the filter-equalizer output signal; and (f) repeating steps (c) through (e) until occurrence of a predetermined event.

26. The method of claim 25, wherein the predetermined event comprises the difference between the generator output signal and the filter-equalizer output signal reaching a selected level.

27. The method of claim 25, wherein the predetermined event comprises passage of a selected time.

28. The method of claim 25, further comprising steps of, after occurrence of the predetermined event, operating the wireline logging telemetry system according to steps comprising:

(g) transmitting on the wireline logging cable data signals corresponding to downhole measurements;

(h) generating digitized data signals by receiving and digitizing the data signals;

(i) shifting the coefficient signals with respect to the taps to most efficiently configure the filter-equalizer to an impulse response characteristic of the logging cable;

(j) sequentially advancing the digitized data signals into the filter-equalizer to provide a filter-equalizer data output signal;

(k) providing a sliced output signal by operating a slicer to associate the filter-equalizer data output signal with discrete signal values; and (l) adapting the coefficient signals in response to the digitized data signals present in the filter-equalizer and the difference between the sliced output signal and the filter-equalizer data output signal.

29. A mud pulse telemetry system with improved initialization characteristics, comprising:

(a) a downhole training sequence transmitter to repeatedly transmit a training signal through a mud column, wherein the training signal comprises a specified periodic pseudorandom training sequence with a repeating pattern, wherein the pattern includes a selected number of symbols; and (c) a surface modem operatively coupled to the mud column, programmed to perform initialization steps comprising:

(1) generating a digital signal by receiving and digitizing the training sequence sent by the transmitter;

(2) sequentially advancing the digital signals into a finite impulse response filter-equalizer to provide a filter-equalizer output signal, wherein the filter-equalizer includes a set of adjustable coefficient signals equal in number to the selected number of symbols in the repeating pattern of the training sequence;

(3) generating the training sequence independent of the transmitter to form a generator output signal; and (4) adapting the coefficient signals of the filter-equalizer in response to the digital signal and the difference between the generator output signal and the filter-equalizer output signal.

30. The system of claim 29, wherein operation of the training sequence transmitter is initiated upon power up.

31. The system of claim 29, wherein operation of the training sequence transmitter is initiated when the training sequence transmitter receives a specified signal from the surface modem.

32. The system of claim 29, wherein the surface modem is further programmed to adapt the coefficient signals at a rate that is responsive to a specified sensitivity constant.

33. The system of claim 29, wherein the surface modem is further programmed to adapt each particular coefficient signal of the filter-equalizer as follows:

$$C_{new}=C_{old}+\beta*ERR*DV,$$

wherein, $C_{new}$ represents a new version of the particular coefficient signal, $C_{old}$ represents a previous version of the particular coefficient signal, ERR corresponds to the difference between the generator output signal and the filter-equalizer output signal, and DV corresponds to a portion of the digital signal advanced into the filter-equalizer that corresponds to the particular coefficient signal.

34. The system of claim 33, wherein the surface modem is further programmed to associate the filter-equalizer output signal with discrete signal values to provide a slicer output signal, and wherein the surface modem is also programmed to enter an operational mode at a selected time, in which the coefficient signals are adapted in response to the digital signal advanced into the filter-equalizer and the difference between the slicer output signal and the filter-equalizer output signal.

35. The system of claim 29, wherein the coefficient signals are initially set to zero.

36. The system of claim 29, wherein a selected number of the coefficient signals are adapted according to step (4) between each said sequential advancement of step (2).

37. The system of claim 29, wherein all of the coefficient signals are adapted according to step (4) between each said sequential advancement of step (2).

38. The system of claim 29, wherein only a selected number of digitized signals corresponding to received symbols are advanced into the filter-equalizer in step (c)(2) and the selected signals are rotated through the filter-equalizer rather than advancing newly received and digitized signals into the filter-equalizer.

39. The system of claim 38, wherein the selected number of digitized signals advanced into the filter-equalizer is equal to the number of symbols in the training sequence.

40. A method for initializing a mud pulse telemetry system, comprising steps of:

(a) using a transmitter to repeatedly transmit a specified pseudorandom training sequence through a mud column, wherein the sequence includes a selected number of symbols; and (b) receiving and digitizing signals sent by the transmitter through the mud column;

(c) sequentially advancing the digitized signals into a finite impulse response filter-equalizer to provide a filter-equalizer output signal, wherein the filter-equalizer includes a selected number of taps and a set of adjustable coefficient signals equal in number to the symbols in the training sequence, wherein each coefficient signal is associated with a different tap;

(d) providing a generator output signal by repeatedly generating the pseudorandom training sequence at a generator output independent of the transmitter; and (e) adapting the coefficient signals of the filter-equalizer in response to the digitized signals advanced into the filter-equalizer and the difference between the generator output signal and the filter-equalizer output signal.

41. The method of claim 40, wherein each particular coefficient signal in step (e) is adapted according to the following relationship:

$$C_{new}=C_{old}+\beta*ERR*DV,$$

wherein, $C_{new}$ represents the particular coefficient signal as adapted, $C_{old}$ represents the particular coefficient signal prior to adapting, ERR corresponds to the difference between the generator output signal and the filter-equalizer output signal, and DV corresponds to a specified digitized signal advanced into the filter-equalizer that corresponds to the particular coefficient signal.

42. The method of claim 41, further including steps comprising:

(f) operating a slicer to provide a sliced output signal by associating the filter-equalizer output signal with discrete signal values; and (g) entering an operational mode at a selected time wherein ERR corresponds to the difference between the sliced output signal and the filter-equalizer output signal.

43. The method of claim 40, further including steps comprising:

(f) operating a slicer to provide a sliced output signal by associating the filter-equalizer output signal with discrete signal values; and (g) determining when the sliced output signal corresponds to the generator output signal.

44. The method of claim 40, further comprising a step of stabilizing the coefficient signals by continuing to perform steps (a) through (e) for a selected time.

45. The method of claim 42, wherein the selected time corresponds to a time at which the sliced output signal corresponds to the generator output signal.

46. The method of claim 42, wherein step (g) further comprises a step of shifting the coefficient signals with respect to the taps to associate the largest coefficient signal with a selected tap.

47. The method of claim 42, wherein step (g) further comprises a step of shifting the coefficient signals with respect to the taps to most efficiently adapt the filter-equalizer to an impulse response characteristic of the logging cable.

48. The system of claim 42, wherein only a selected number of digitized signals corresponding to received symbols are advanced into the filter-equalizer in step (c) and the selected signals are rotated through the filter-equalizer rather than advancing newly received and digitized signals into the filter-equalizer.

49. The method of claim 42, wherein the selected number of digitized signals advanced into the filter-equalizer is equal to the number of symbols in the training sequence.

* * * * *